US006879257B2

(12) United States Patent
Hisano et al.

(10) Patent No.: US 6,879,257 B2
(45) Date of Patent: Apr. 12, 2005

(54) STATE SURVEILLANCE SYSTEM AND METHOD FOR AN OBJECT AND THE ADJACENT SPACE, AND A SURVEILLANCE SYSTEM FOR FREIGHT CONTAINERS

(75) Inventors: Atsushi Hisano, San Jose, CA (US); Akihiko Nakamura, Kyoto (JP)

(73) Assignee: Omron Corporation, Kyoto (JP)

( * ) Notice: Subject to any disclaimer, the term of this patent is extended or adjusted under 35 U.S.C. 154(b) by 196 days.

(21) Appl. No.: 10/200,552

(22) Filed: Jul. 23, 2002

(65) Prior Publication Data

US 2003/0164763 A1 Sep. 4, 2003

Related U.S. Application Data

(63) Continuation-in-part of application No. 10/119,310, filed on Apr. 10, 2002, which is a continuation-in-part of application No. 10/080,927, filed on Feb. 25, 2002.

(51) Int. Cl.[7] ..... G08B 13/12

(52) U.S. Cl. ..... 340/568.2; 340/539.21; 340/539.23; 340/572.1; 709/224; 370/254

(58) Field of Search ..... 340/568.2, 572.1, 340/539.1, 825.49, 539.23, 539.36, 540; 235/437, 337, 491, 435, 438, 375; 709/220–224; 370/254

(56) References Cited

U.S. PATENT DOCUMENTS

| | | | | | |
|---|---|---|---|---|---|
| 3,733,602 | A | * | 5/1973 | Cuckler et al. | 342/27 |
| 5,049,858 | A | * | 9/1991 | Price | 340/552 |
| 5,198,799 | A | * | 3/1993 | Pascale | 340/552 |
| 5,289,559 | A | * | 2/1994 | Wilson | 385/136 |
| 5,826,578 | A | * | 10/1998 | Curchod | 600/595 |
| 5,831,260 | A | * | 11/1998 | Hansen | 250/221 |
| 5,892,441 | A | * | 4/1999 | Woolley et al. | 340/539.26 |
| 5,917,405 | A | * | 6/1999 | Joao | 340/426.17 |
| 6,002,334 | A | * | 12/1999 | Dvorak | 340/568.1 |
| 6,028,857 | A | * | 2/2000 | Poor | 370/351 |
| 6,141,293 | A | * | 10/2000 | Amorai-Moriya et al. | 367/127 |
| 6,487,516 | B1 | * | 11/2002 | Amorai-Moriya | 702/152 |
| 6,577,238 | B1 | * | 6/2003 | Whitesmith et al. | 340/572.1 |
| 6,614,350 | B1 | * | 9/2003 | Lunsford et al. | 340/572.1 |

* cited by examiner

*Primary Examiner*—Benjamin C. Lee
(74) *Attorney, Agent, or Firm*—Foley & Lardner LLP

(57) ABSTRACT

The objective of the present invention is to detect, using a universal method, any "movement" inside of the object being monitored, while maintaining the security of a container. The movement inside of the object to be monitored includes 1) a human movement when a human enters into a container to be monitored, 2) a movement to bring a foreign article in, 3) a movement to take cargo out. To achieve the objective, this invention uses the concept of a so-called "inside-seal". In actual configuration, a plurality of communication units (communication nodes) are installed on the walls of the container. These communication units have a predetermined powered communication capability and form a communication network communicating with each other. A communication status between each node and all of the other nodes provided in the network, and a network graph matrix is generated which defines the nodal relationship between the nodes. Since the matrix is determined not only by the property of the object to be monitored, but also by the spatial condition within the container, it is possible to detect even a small change in the space. According to the first preferred embodiment, each node transmits a low power electric wave which can reach only neighboring nodes, and each node can transmit data to remote nodes only by relaying the data to the neighboring nodes. The relaying counts (HOP counts) of each node to communicate with all of the other nodes are obtained, and based on these relaying counts, a network graph matrix is generated which defines the relaying counts to communicate between all nodes. According to the second preferred embodiment, each node transmits UWB waves to all of the other nodes, which can reach to all of the other nodes, and the distances between all the nodes are measured and a network graph matrix between all the nodes is generated.

19 Claims, 25 Drawing Sheets

Surveillance system 200

Figure 6(A)

600

| | 15 | 665 | 144 | 123 | 1 | 802 | 598 | 88 | 360 | 166 | 132 | 449 | 195 | 10 | 91 | 177 |
|---|---|---|---|---|---|---|---|---|---|---|---|---|---|---|---|---|
| 15 | 0 | 0 | 1 | 0 | 0 | 0 | 0 | 0 | 0 | 0 | 0 | 0 | 0 | 0 | 0 | 0 |
| 665 | 0 | 0 | 1 | 1 | 0 | 0 | 0 | 0 | 0 | 0 | 0 | 0 | 0 | 0 | 0 | 0 |
| 144 | 1 | 1 | 0 | 1 | 0 | 1 | 0 | 0 | 0 | 0 | 0 | 0 | 0 | 0 | 0 | 0 |
| 123 | 0 | 1 | 1 | 0 | 1 | 0 | 1 | 1 | 1 | 0 | 0 | 0 | 0 | 0 | 0 | 0 |
| 1 | 0 | 0 | 0 | 1 | 0 | 0 | 0 | 1 | 1 | 0 | 0 | 0 | 0 | 0 | 0 | 0 |
| 802 | 0 | 0 | 1 | 0 | 0 | 0 | 1 | 0 | 0 | 1 | 0 | 0 | 0 | 0 | 0 | 0 |
| 598 | 0 | 0 | 0 | 1 | 0 | 1 | 0 | 1 | 0 | 0 | 1 | 0 | 0 | 0 | 0 | 0 |
| 88 | 0 | 0 | 0 | 1 | 1 | 0 | 1 | 0 | 1 | 0 | 1 | 1 | 0 | 0 | 0 | 0 |
| 360 | 0 | 0 | 0 | 1 | 1 | 0 | 1 | 0 | 0 | 0 | 1 | 1 | 0 | 0 | 0 | 0 |
| 166 | 0 | 0 | 0 | 0 | 0 | 1 | 0 | 0 | 0 | 0 | 0 | 0 | 1 | 0 | 0 | 0 |
| 132 | 0 | 0 | 0 | 0 | 0 | 0 | 1 | 1 | 1 | 0 | 0 | 1 | 0 | 1 | 0 | 0 |
| 449 | 0 | 0 | 0 | 0 | 0 | 0 | 0 | 1 | 1 | 0 | 1 | 0 | 0 | 1 | 1 | 0 |
| 195 | 0 | 0 | 0 | 0 | 0 | 0 | 0 | 0 | 0 | 1 | 0 | 0 | 0 | 1 | 0 | 1 |
| 10 | 0 | 0 | 0 | 0 | 0 | 0 | 0 | 0 | 0 | 0 | 1 | 1 | 1 | 0 | 1 | 1 |
| 91 | 0 | 0 | 0 | 0 | 0 | 0 | 0 | 0 | 0 | 0 | 0 | 1 | 0 | 1 | 0 | 0 |
| 177 | 0 | 0 | 0 | 0 | 0 | 0 | 0 | 0 | 0 | 0 | 0 | 0 | 1 | 1 | 0 | 0 |

Figure 6(B)

600'

| | 15 | 665 | 144 | 123 | 1 | 802 | 598 | 88 | 360 | 166 | 132 | 449 | 195 | 10 | 91 | 177 |
|---|---|---|---|---|---|---|---|---|---|---|---|---|---|---|---|---|
| 15 | 0 | 0 | 1 | 0 | 0 | 0 | 0 | 0 | 0 | 0 | 0 | 0 | 0 | 0 | 0 | 0 |
| 665 | 0 | 0 | 1 | 1 | 0 | 0 | 0 | 0 | 0 | 0 | 0 | 0 | 0 | 0 | 0 | 0 |
| 144 | 1 | 1 | 0 | 1 | 0 | 1 | 0 | 0 | 0 | 0 | 0 | 0 | 0 | 0 | 0 | 0 |
| 123 | 0 | 1 | 1 | 0 | 1 | 0 | 1 | 1 | 1 | 0 | 0 | 0 | 0 | 0 | 0 | 0 |
| 1 | 0 | 0 | 0 | 1 | 0 | 0 | 0 | 1 | 1 | 0 | 0 | 0 | 0 | 0 | 0 | 0 |
| 802 | 0 | 0 | 1 | 0 | 0 | 0 | 1 | 0 | 0 | 1 | 0 | 0 | 0 | 0 | 0 | 0 |
| 598 | 0 | 0 | 0 | 1 | 0 | 1 | 0 | 1 | 0 | 0 | 1 | 0 | 0 | 0 | 0 | 0 |
| 88 | 0 | 0 | 0 | 1 | 1 | 0 | 1 | 0 | 1 | 0 | 1 | 1 | 0 | 0 | 0 | 0 |
| 360 | 0 | 0 | 0 | 1 | 1 | 0 | 1 | 0 | 0 | 0 | 1 | 1 | 0 | 0 | 0 | 0 |
| 166 | 0 | 0 | 0 | 0 | 0 | 1 | 0 | 0 | 0 | 0 | 0 | 0 | 1 | 0 | 0 | 0 |
| 132 | 0 | 0 | 0 | 0 | 0 | 0 | 1 | 1 | 1 | 0 | 0 | 1 | 0 | 0 | 0 | 0 |
| 449 | 0 | 0 | 0 | 0 | 0 | 0 | 0 | 1 | 1 | 0 | 1 | 0 | 0 | 0 | 0 | 0 |
| 195 | 0 | 0 | 0 | 0 | 0 | 0 | 0 | 0 | 0 | 1 | 0 | 0 | 0 | 1 | 0 | 1 |
| 10 | 0 | 0 | 0 | 0 | 0 | 0 | 0 | 0 | 0 | 0 | 0 | 0 | 1 | 0 | 1 | 1 |
| 91 | 0 | 0 | 0 | 0 | 0 | 0 | 0 | 0 | 0 | 0 | 0 | 0 | 0 | 1 | 0 | 0 |
| 177 | 0 | 0 | 0 | 0 | 0 | 0 | 0 | 0 | 0 | 0 | 0 | 0 | 1 | 1 | 0 | 0 |

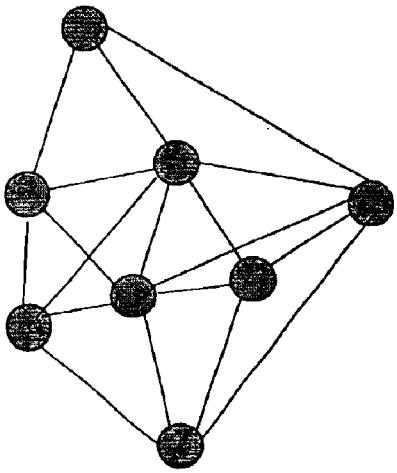
Figure 12(A
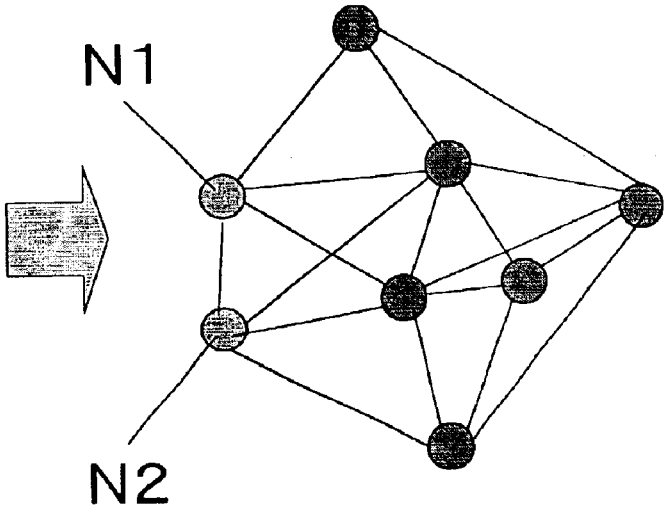
Figure 12(B

| | N1 | N2 | N3 | N4 | N5 | N6 |
|---|---|---|---|---|---|---|
| N1 | 0 | 30 | 40 | 25 | 50 | 80 |
| N2 | 30 | 0 | 24 | 67 | 43 | 75 |
| N3 | 40 | 24 | 0 | 36 | 41 | 55 |
| N4 | 25 | 67 | 36 | 0 | 74 | 58 |
| N5 | 50 | 43 | 41 | 74 | 0 | 24 |
| N6 | 80 | 75 | 55 | 58 | 24 | 0 |

Fingerprint
(initial)

Figure 15(A)

| | N1 | N2 | N3 | N4 | N5 | N6 |
|---|---|---|---|---|---|---|
| N1 | 0 | 30 | -1 | 25 | 72 | 80 |
| N2 | 30 | 0 | -1 | 67 | 63 | 75 |
| N3 | -1 | -1 | 0 | -1 | -1 | -1 |
| N4 | 25 | 67 | -1 | 0 | 104 | 58 |
| N5 | 72 | 63 | -1 | 104 | 0 | 45 |
| N6 | 80 | 75 | -1 | 58 | 45 | 0 |

Current
(monitoring)

Figure 15(B)

| | N1 | N2 | N4 | N6 |
|---|---|---|---|---|
| N1 | 0 | 30 | 25 | 80 |
| N2 | 30 | 0 | 67 | 75 |
| N4 | 25 | 67 | 0 | 58 |
| N6 | 80 | 75 | 58 | 0 |

Fingerprint (initial)

Figure 16 (A)

| | N1 | N2 | N4 | N6 |
|---|---|---|---|---|
| N1 | 0 | 30 | 35 | 93 |
| N2 | 30 | 0 | -1 | 87 |
| N4 | 35 | -1 | 0 | 58 |
| N6 | 93 | 87 | 58 | 0 |

Current (monitoring)

Figure 16(B)

Figure 18

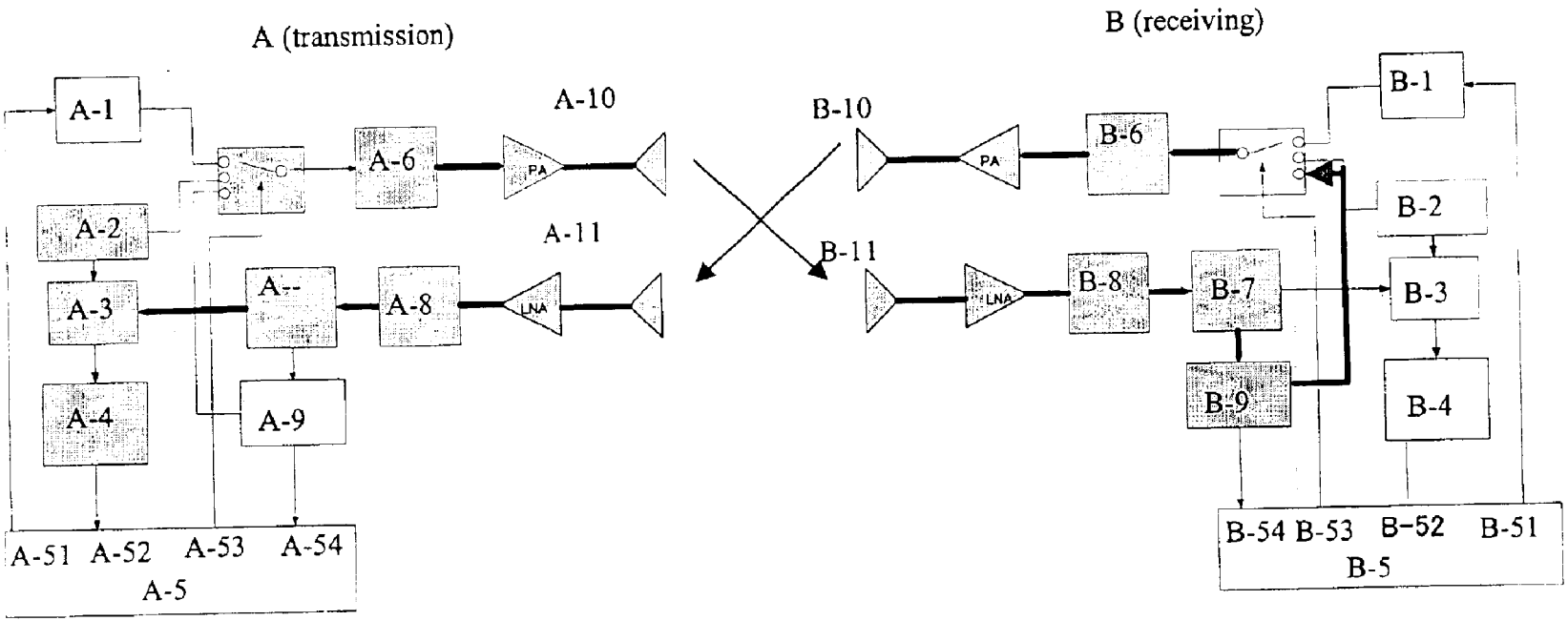

A-1, B-1; Transmission data
A-2, B-2; Pseudo-random code array (PN code)
A-3, B-3; Interrelationship correlator
A-4, B-4; Calculation a distance
A-5, B-5; Controller
A-51, B-51; Transmission data
A-52, B-52; Measuring a distance
A-53, B-53; Transmission control
A-54, B-54; Receiving data A-6, B-6; Generating impulse
A-7, B-7; PN code regenerator
A-8, B-8; Inpulse demodulation
A-9, B-9; Data demodulation
A-10, B-10; Transmission antenna
A-11, B-11; Receiving antenna

Figure 20

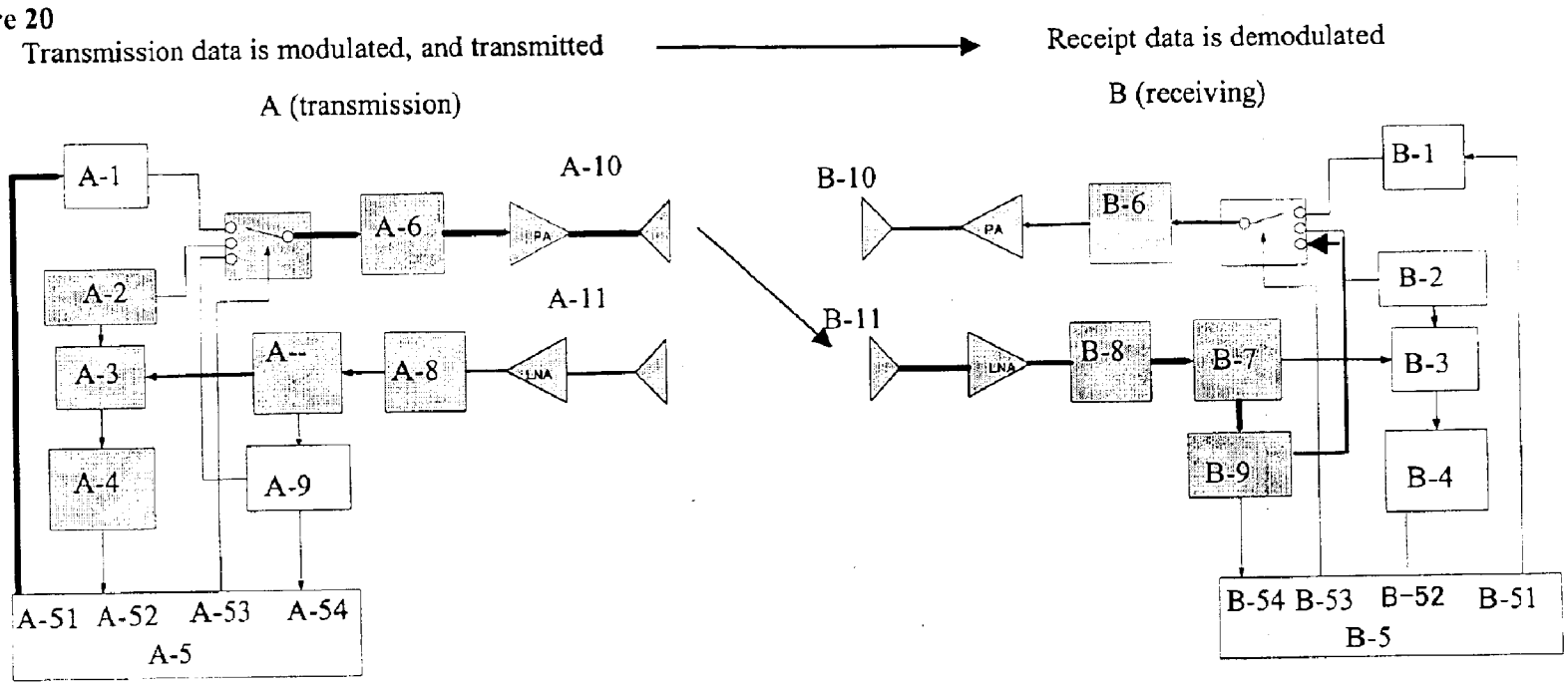

A-1, B-1; Transmission data
A-2, B-2; Pseudo-random code array (PN code)
A-3, B-3; Interrelationship correlator
A-4, B-4; Calculation a distance
A-5, B-5; Controller
A-51, B-51; Transmission data
A-52, B-52; Measuring a distance
A-53, B-53; Transmission control
A-54, B-54; Receiving data A-6, B-6; Generating impulse
A-7, B-7; PN code regenerator
A-8, B-8; Impulse demodulation
A-9, B-9; Data demodulation
A-10, B-10; Transmission antenna
A-11, B-11; Receiving antenna

STATE SURVEILLANCE SYSTEM AND METHOD FOR AN OBJECT AND THE ADJACENT SPACE, AND A SURVEILLANCE SYSTEM FOR FREIGHT CONTAINERS

FIELD OF TECHNOLOGY OF THE INVENTION

The present invention relates to a Surveillance system to monitor any movement of an object of surveillance and the space proximate to the object (e.g. inside of warehouse, containers, vehicles, office or dwelling rooms, or the outside area of the warehouse), and a surveillance method using the same. This invention further relates to a detecting system to detect any unauthorized access into a freight container and swapping of the authorized freight container with an unauthorized freight container.

This is a continuation-in-part application of currently pending U.S. patent application filed Feb. 25, 2002, (application Ser. No.: 10/080,927), U.S. patent application filed Apr. 10, 2002, (application Ser. No.: 10/119,310).

BACKGROUND OF THE INVENTION

As exemplified by the terrorist attacks in the United States on Sep. 11, 2001, the increasingly frequent acts of terror internationally dictate the importance of risk management for freight containers that are transported by aircraft, ships, freight trains and trucks. The possibility exists that a terrorist could secrete a nuclear weapon, explosives, poison gas, a biological weapon, or a radioactive substance into a freight container and send it anywhere. Freight containers are used to ship a wide variety of products and raw materials. It has been estimated that 18 million containers arrive in the United States annually. Currently, only about 2% of those are inspected. There are cases in which X-rays can be used from the outside of the container and the resulting image can be analyzed to identify dangerous items that have been secreted therein. In addition, radiation detectors and odor sensors can also be used to identify some dangerous articles. However, considering the diversity of possible threats and the number of ways that dangerous articles can be packaged to appear innocuous, it must be concluded that detection of dangerous articles is not possible in most cases. It must further be considered that dangerous articles are not always secreted into containers after they are closed, these articles could be placed into the container in the first place, or containers can be swapped out for others. Theft of cargo from containers has long been a problem, but there exists a clear risk that such theft rings can work in league with terrorists to secrete dangerous articles into the containers even as they steal cargo from them. Since it is not easy to use sensors to check cargo for danger, there are movements afoot to check the reliability of the shippers to evaluate the risk of the cargo they load. However, an empty container, which has no shipper, cannot be evaluated based on the reliability of a shipper. Since the demand for container transportation of cargo is not stable, varying by geographical area and the season of the year, there are many cases when empty containers must be transported among many countries by air, ship, rail and truck. This transportation of empty containers brings no profit to freight shippers, and accordingly, there is a strong tendency to avoid the cost of security measures when shipping empty containers. Thus, there is a high possibility that an empty container could be used as a terrorist tool. It follows that the surveillance and reporting of any unauthorized opening of an empty container's doors or walls is a very important anti-terrorism measure. To wit, as anti-terrorism measures, it is necessary to (1) monitor and report any unauthorized access to the inside of a container be it loaded with cargo or empty, and (2) to detect and report any swapping of containers.

PRIOR ART

The following are the prior arts relating to the products and U.S.A patent applications to seal the freight containers. FIG. 25(A) shows a mechanical seal, so called as SEALOCK, which is released by Omni Security Consultants, Inc. FIG. 25(B) shows a conventional mechanical seal for a container door of Shaw Container Service Inc. The mechanical seal connects the door handle or fixtures so that an unauthorized person cannot open the door. The seal can be opened only by a key which only an authorized person has. With this kind of mechanical seal, the material of the seal is made by hard metal and it is difficult to cut the hard metal to open the door. If it could be done, the fact is that it would be easily visually detected at a later time. If the cut portion was fixed to conceal entry of the container, the fixed portion is also easily visually detected. It is, however, relatively easy to copy a key and this can lower the security level. This will be a serious problem specially against terrorists bringing dangerous materials into the container. Further, since the seal is installed outside of the container, if the terrorist were to prepare an identical bogus seal, it would be easy for the terrorist to swap the right seal with the bogus one.

FIG. 26(A) shows a so-called E-seal, which is an electronic container seal system of E. J. Brooks Company, which allows the shipper to communicate with the container provided with this E-seal. It can be used for high value shipments traveling via ground, rail or ocean. With this E-seal, if an authorized person wishes to open the door on which this E-seal is installed, he has to cut the metal rod or cable. Once the metal rod or cable is cut, an electronic circuit can detect it, and memorize the data in the memory. The data is transmitted to the center when the communication is available. With this system, it is not necessary to check the lock of the container door visually, and it is possible to monitor remotely if the container door is opened or closed. This results in the increase of the number of containers to be checked.

Since this kind of container is installed outside of the freight container, however, it is relatively easy for unauthorized people to sleep the sealing before they attempt the unauthorized access into the container, such as by freezing the electronic circuit rapidly to sleep the monitoring function of the door.

FIG. 26(B) shows another electronic seal released by Hi-G-Tek Inc. of Israel. This seal is known as the Hi-Seal. This Active Hi-Seal is a security device to record the security data, and the data can be read out from a remote place. This device is equipped with a confirmation function to confirm the details of any unauthorized access to the object of surveillance. To wit, the device can record all operations of opening and closing a door, and download the data to a handheld recording unit. The downloaded data in the handheld recording unit includes the time and duration of opening and closing of the door. This can make clear who has a responsibility for security management of the door. The collected data in the recording unit is then downloaded in text file format used for a standard spread sheet and data base. This is a re-usable device, and can be used for 1000 sealings. The battery can be used for several years depending on how often the data is read out in a day. It is not possible to fool the device and not possible to copy the identical device for fooling. The transmitted data between the device and the recording unit is encrypted by 3 DES, and this makes it impossible to copy the data for illegal usage.

Since this device is installed outside the container, it is relatively easy for people to attempt opening the door illegally, for example, by rapidly freezing the electronic circuit to make the surveillance function sleep.

Another seal for a freight container is disclosed in a container device according to U.S. Pat. No. 4,750,197. As shown in FIG. 27, inside of the container, door sensors (38, 40, 42, 44) are provided. A controller is installed in the container, which processes the sensor information to transmit the surveillance and detection signal at the opening/closing of the door, and generates a warning sound. A hole is provided in the ceiling of the container for a lead out of the antenna for a cellular phone and GPS.

With this system, the problems are as follows.

1) Since the location of sensors is fixed, if someone breaks a portion of the container wall, which the sensors cannot detect, this system does not work. Although this system is installed inside of the container, the results would be the same as the E-seal installed outside of the container, because the system configuration is apparent by visual observation, and the intruder will devise a way to fool the system easily.

2) If the controller and sensors are illegally replaced when the system cannot communicate with the center wirelessly during the time that the door is open, and after the dangerous materials are loaded in, in other words, during the time that the system is changed to the inoperative mode to keep recording, then it is no longer possible to detect the fact that the door is illegally opened or closed. This results in the loading of dangerous materials into the container.

Further, U.S. Pat. No. 5,615,247 discloses a seal for a freight container as shown in FIG. 28. Controller 34 is provided inside of container 20, and cables 24, and 25 are exposed outside of the container through door gap 33. The cables exposed outside of the container are hung through door handles 26, 27 and connected to each other by seal 30 for forming a loop which includes controller 20. In order to open the door, it is necessary to open seal 30 or cut cable 24 or 25. Since a controller is provided inside of the container, it has less risk of being attacked by an unauthorized person than the E-seal which is provided outside of the container. Controller 34 can detect the signal indicating one of cables 24, 25, and seal 30 is cut off, and if it happens, then the controller will judge it as an unauthorized door opening, and sends a warning message to the control center wirelessly. The technical problems are as follows.

1) With this system, if cable 24, or 25 are taken off after the handles 26, and 27 are disconnected from the container, controller 34 cannot detect this fact anymore. During such a situation, if dangerous materials are loaded into the container and a new handle is fixed back in place, after cables 24 and 25 are set through, then the controller cannot detect the loading of the dangerous materials. Furthermore, visually the outside of the container will appear to be the same as before, and tampering will not be apparent. As previously mentioned, the weakness of the system is caused by the fact that the security system is apparent visually before the illegal operation is attempted.

2) Another problem of this system is that, if the controller and sensors are illegally replaced when the system cannot communicate with the center wirelessly during the time that the door is open, and after the dangerous materials are loaded in, the system is unable to record or detect whether or not the door has be illegally opened or closed. This results in loading of dangerous materials into the container.

Further, another electronic seal is disclosed in Japanese Patent Publication (Kokai) Hei 09-274077. A transmitter means transmits a diffusion modulated spectral diffusion wave with a prescribed diffusion code that could be reflected inside the detection space. A receiver means outputs a relative peak signal that corresponds to the reception signal strength each time it receives a spectral diffusion wave that matched the diffusion code being used by transmitter means 1. An object, such as a human moving inside the detection space would cause a change in the propagation signal path taken by the spectral diffusion waves being propagated inside the detection space, then the output from the receiver means would show a change in the relative peak signal that corresponded with the aforementioned change. Detecting the change in the output from the relative peak signal thereby enables the detection of movement by an object, such as a human inside the detection space.

1) When the above device is applied in a freight container, since the materials and conditions of the surface material used for the container inner wall or the door depend on the container, it is necessary to set the sensing and judging standard in a receiver means by a technology or know-how of the professional people.

2) Since only one pair of transmitter means and receiver means is used, when either of them is damaged during the loading or transportation, the system will not work at all.

3) Since the installation position of the transmitting and receiver means is fixed, it will be easier for terrorists to attack them from the outside of the container, and it will lower the security level.

As explained above, there are many security problems in the mechanical and electronic seals. To wit, the problems will be as follows.

P1: If the seal is installed outside of a container, it is visually easy to detect what kind of seal is used in advance. This can make it easy for the terrorist to prepare a bogus seal and prepare the unauthorized attack in advance. To wit, the mechanical seal can be replaced by a same kind of bogus seal after the original seal. The electronic seal is also easy to fool. The terrorist can practice in advance the way to fool the electronic circuit used in the same kind of seal, and then freeze the circuit (specially CPU) of the true seal by rapidly freezing means at the container site down to the ultra low temperature to sleep the circuit. The terrorist can open the door during the time that the electronic circuit is sleeping, then they can leave the circuit and restart the function.

Further, If the metal vertical locking bars installed at the both sides of the doors are removed by removing the screws or rivets to hold the bars (shown in FIG. 25(*a*) and FIG. 25(*b*)), it will be possible to open the door without damaging the mechanical and electronic seals.

P2: The authorized person can open the mechanical seal by a mechanical key, and the electronic seal can be opened by the same kind of person by a password. If the authorized person is one of the terrorists, the mechanical key and the password are easily stolen by them, and they can easily open the seal without fooling the seals, and the seals can not detect such illegal operations.

P3: In mechanical and electronic seals, it is impossible to detect the attacks to another part of the container other than the door if the detection is only for the opening of the door. The material of the container is either steel or aluminum, and the thickness of the material is approximately 2 mm thick.

This makes it easy to drill the wall panels by a drilling machine, or make a hole by a burner or a laser device. Thus, the sealing method to seal only the door does not work to protect from attacks other than the door.

In the conventional seals for containers to protect against the terrorist attack, not only are there the conventional technical issues as above P1, P2, P3, but also there are more issues as follows to be improved from the point of security level.

P4: There are already a huge quantity of containers in the world. Further, more than 18 million containers are brought into the United State in a year. The seals, therefore, must be able to be easily installed by non-professional staffs.

P5: Because of the problems explained in P1, it is necessary to monitor the containers from the inside. Since the containers are, however, used in various conditions, the inner surface of the doors and the walls are covered with painted materials and rust. The monitoring must be, therefore, possible for any kind of surface conditions.

P6: The sensors which are usable for "any kind of surface conditions" explained in P5, must not be the kind of sensors which requires individual adjustments to adjust for each condition of the container door and inner wall. It is because it is difficult to keep such professional staffs employed who are capable of performing such adjustments at the loading site, and thus must keep the adjustment site for such works.

P7: The loading of freight cargo into and from the containers will be done by folk lift and man power. It happens often that, during the loading, the freight cargos and the folk lifts crash into the inner walls of the containers and damage them. If the sensors to monitor the inside of the containers are installed inside of the containers, they may be damaged by such an accident. If only one sensor is installed in the container, and it is damaged by an accident, then it will be no longer be possible to monitor the inside of the container. It is, therefore, necessary to install a plurality of sensors at many places in the containers, and collect the monitoring information from the non-damaged sensors, and the illegal invasion must be totally judged by the monitoring information from the non-damaged sensors.

P8: In order to detect the swapping of a legitimate container with a bogus container, ID information must be assigned for each container, and the registered ID information must be kept at an isolated place from the containers.

P9: The containers must have a configuration which makes it difficult to be attacked. If they are attacked, they must detect such attacks, and they must have a function to reveal the fact they have been attacked.

Analysis of the Configuration to be Solved, and the Countermeasure

Before explaining the overall of this invention, the analysis of the configuration to be solved and the countermeasure for detecting the attack to the containers, must be explained as follows. Among the issues explained at P1–P9, P1 is specially important for the countermeasure for the attacks by terrorists. P1 shows that the seals installed outside of the containers do not work at all against the terrorists who try to access the containers illegally even if a huge amount of man power and costs are spent for it. This shows that it is necessary to install an "inside seal" which seals containers from inside of the containers. P2 shows the issue about how to keep the security when an authorized person opens a seal of the container. P8 shows the issue about how to realize the ID information to judge if a container is a right or bogus container. This can conclude that the inside seal must be used to monitor a container from the inside of the container, and the monitoring functions of the inside seal must solve the issues shown in P3, P4, P5, P6, and P7. It is difficult, but not impossible, to attack the inside seal which detect the attack to the container although the inside seal can heighten the security level more than using the conventional outside seal. Therefore, the countermeasure to protect a container from the illegal operation which attacks the container after making the seal sleep, is still necessary, and the issue shown in P9 must be solved. Table 1 shows the realistic means to solve the issues, and table 2 shows the comparison between the realistic means and the issues to be solved for protecting the containers from terrorist attacks. This shows that means 4 according to this invention is the best way to solve the issues.

TABLE 1

| Means | Explanation of the means |
|---|---|
| Means 1 | This means emits an energy beam such as light or sound from a inside of a container onto an inner surface of the container door or wall, then a sensor detects the reflection of the energy, and the reflection can be analyzed for detecting the movement of the door and the drilling to the inner wall. |
| Means 2 | This means installs a mechanical switch on an inner surface of a container door, and the switch is turned ON and OFF by the movement of the door. |
| Means 3 | This means installs a transmitting means to transmit the electronic wave in a container, and the received signals wave is analyzed for any changes of the inside of the container. Japanese Patent Publication, Hei 09-274077. |
| Means 4 (An application of this invention) | This means installs a plurality of communication nodes on an inner wall or door of a container, and the link status between the nodes is monitored. The link status can represent the movement of the door and the wall, and a status of the proximity of a predetermined portion of the container. Further, this link status can resemble a fingerprint of the object to be monitored (which is the sensing method according to this invention). |

TABLE 2

| Issues to be solved | Means 1 | Means 2 | Means 3 | Means 4 |
|---|---|---|---|---|
| Issues as surveillance | | | | |
| P3: Not only door, but also an inner wall must be monitored | O | X | O | O |
| P4: Seals must be installed inside of container easily | X | O | O | O |
| P5: A container having various kinds of inner surfaces must be monitored | O | O | O | O |
| P6: No professional staff is needed for the adjustment of the system | X | O | X | O |
| P7: Robust configuration for a partial damage is required | X | X | X | O |
| Against attacking | | | | |
| P2: A key for access into the container must be well protected against a theft | ? | ? | ? | O |
| P9: A seal must be protected from attacking | X | X | X | O |
| For bogus container | | | | |
| P8: An ID information which is not possible to copy must be assigned to a container | ? | ? | X | O |
| Overall evaluation | Not proper | Not proper | Not proper | Proper |

TABLE 2-continued

| Issues to be solved | Means 1 | Means 2 | Means 3 | Means 4 |
|---|---|---|---|---|

O: Proper means
X: Not Proper
?: Not sure

SUMMARY OF THE INVENTION

The first objective of the present invention is to detect, using a universal method, any "movement" in the object being monitored while maintaining security, which is not dependent on the kind of sensors that are used.

For example, if the object being monitored is a freight container, and the monitoring is performed from the inside of the container, the monitoring is to monitor 1) opening/closing of the door, and drilling of the wall, 2) any movement of the cargo in the container, 3) any attack to a seal and to record the data of any such attack.

The second objective of the present invention is to provide the capability of detecting the substitution of an object being monitored, such as swapping an object. For example, if the object being monitored is a freight container, the capability includes the detection of a swapping of a legitimate container with a bogus container which is loaded in advance with an explosive material.

In order to achieve the objectives mentioned above, the present invention uses a so called "Hagoromo" method which seals a container from the inside of a container (this is called an "inside seal").

The Hogoromo method is-a sensing method which was disclosed in the U.S. patent application filed on Feb. 25, 2002, (Ser. No. 10/080,927) and the U.S. patent application filed on Apr. 10, 2002, (Ser. No. 10/119,310). The sensing method is characterized by the configuration of sensors which can detect any movement of any object to be monitored and a status of the proximity area of the object by monitoring a link status between a plurality of communication nodes attached to the monitoring object, and the linking status data can be used as a characteristic fingerprint to identify the object to be monitored.

The technical issues to be solved which are mentioned above can be solved by using the Hagoromo method for the application of a plurality of communication nodes and the monitoring of the inside seal of the container from the inside widely covering the container wall as a sensing area, by automatically generating a password for opening and closing a door from the generated fingerprint, and by deleting the un-reproducible fingerprint if an attack to the seal is detected.

FIG. 1 shows the conventional sensing method, and FIG. 2 shows the concept of the Hagoromo sensing method. For example, container 110 is an object to be monitored. If freight cargo 120 is loaded into container 110, according to the conventional sensing method, various sensors, for example, displacement laser sensors 130 are installed in container 110 to detect the displacement of the container door and the inner wall, or the freight cargo to be monitored. It is necessary in this method, however, to correctly set the proper sensitivity of the sensors according to the properties of the object to be monitored (materials, surface conditions, and size, etc.), to correctly set the threshold value for judgment, and to correctly adjust the installation and positioning of the sensors, and to correctly set the installation angles. If the monitoring condition must be adjusted for each property of the object to be monitored, then the method can not be a universal monitoring method for monitoring various kinds of objects. Further, according to the conventional sensing method, unless the sensors are installed at fixed positions in a container, it will be difficult for non-professional people to perform this kind of a manual installation. If the installation position is fixed in the container, then it will weaken the system when the sensors are attacked.

According to this invention, therefore, the system can work independently from the property of the container door and the inner wall (materials, surface conditions, and size, etc.) to be monitored. Firstly, a plurality of wireless communication devices (communication nodes) 140 are installed on inner walls of container 110. Each communication device has a transmitting and receiving function, and they are able to communicate with each other. The plurality of communication devices form a communication network 150. Secondly, the characteristic communication property data between any two communication nodes (referred to as nodes hereafter) in this communication network is detected, and then a network graph matrix is generated which comprises the communication property data. This generated matrix can represent the distribution of nodes in the container to be monitored, the status of the door if it is opened or closed, the movement of the freight cargo loaded in the container, and the spatial status in the container. According to the first preferred embodiment of this invention, the communication property data is obtained as follows. Each node emits low-power electric waves which can communicate only with the neighboring nodes. Each node can communicate with other remote nodes only via their neighboring nodes which relay the low-power electric waves to other neighboring nodes located nearby. Then, each relay count (referred to as HOP count hereafter) to establish the communication between any two nodes is obtained, and a network graph matrix is generated based on using these HOP counts as a matrix factor. The factor number (s, p) in the network graph matrix represents the communication property data between node s and node p. This communication property data can be referred to as link information between node s and node p. Since a network graph matrix is changed according to the displacement of a door and wall of a container, it is possible to monitor the container status by monitoring the network graph matrix.

According to the second preferred embodiment of this invention, each communication node emits Ultra Wide Band electric waves (referred to as UWB hereafter), and receives the responding electric waves from other nodes, and obtains the time lag between the emitting time and the receiving time. Based on this time lag, the distance between the two nodes can be calculated. If the emitted electric waves for obtaining the distance are interrupted by an invading article, the distance cannot be obtained. Further, if the emitted electric waves are interrupted by an invading article, the reflection waves can be detected and the distance between the node and the invading article can be obtained. In either case, both the no distance data and the distance data to the invading article can be used for information of the invading article. The distance data can be used for generating the network graph matrix. If the matrix and the information of an invading article near the nodes are monitored, it is possible to monitor the status of a container.

A network graph matrix is obtained by the relaying count (HOP count) between each two nodes according to the first preferred embodiment, and by the distance between each two nodes according to the second preferred embodiment. If all nodes continue to function, and if none of the attached nodes fall down inside of the locked container, the network graph matrix remains the same as the original matrix just as a fingerprint. The network graph matrix can be, therefore, used as a characteristic ID information which represents a specific container. Human fingerprints, which include stains or wounds, can be an ID if such stains and wounds are removed from the fingerprint. Thus, just like the human fingerprint, if the network graph matrix generated by the communication network includes some non-functioning or fallen down nodes, it can be still be usable for identifying the container, and detecting the status change in the container if the data is used properly.

To wit, the present invention has the following characteristic properties.

1. In the conventional sensors to detect an abnormal status in a container, the installation positions of such sensors are fixed. This makes it easy for terrorists to pre-arrange an attack on the sensors. The nodes used in the inside-seals are not, installed at fixed positions in a container, because this irregular arrangement can prevent terrorists from pre-arranging an attack strategy. In order to avoid installing the nodes at fixed positions, they can be installed randomly or in irregular positions, which cannot be seen by a third party.

2. The password for opening and closing a door according to this invention is automatically generated at a surveillance center remotely located away from any of the container operating companies. This is to assure that there can not be a partner of the terrorists working in any of the container operating companies, and prevents the ability for theft of any password for the illegal opening and closing of the container door. This arrangement can prevent any such illegal operation.

3. If the inside-seal provided in a container is attacked, or an illegal opening or closing of the door is detected, then the "electronic fingerprint" recorded in the container, which corresponds to the electronic fingerprint recorded in the surveillance center, is deleted automatically. Since the electronic fingerprint was randomly generated, it will not be possible to regenerate an identical electronic fingerprint. When terrorists open the container illegally or prepare a bogus container to swap with a true container, these bogus containers have no fingerprint data, and it can be judged that they are, in fact, bogus containers. When it happens that the container cannot send the sensing data of the illegal opening or closing of a door to the surveillance center wirelessly, this function can still identify the container which has been attacked by requesting containers to display their electronic fingerprint.

4. Not only detecting any illegal opening or closing of the door, this invention can detect whether or not any dangerous materials have been inserted through a hole made by a drill, burner, or laser beam, and if an illegal person has entered the container.

5. In order to prevent dangerous containers from entering into the USA during transportation by a container ship, the surveillance system according to this invention makes it possible to detect such illegal loading into a container during the time that the container is still on a board of a container ship, and sends a warning signal to the surveillance center, so that the surveillance center can relay such information to the Coast Guard before the container arrives to the destination port.

The present invention is applicable to a wide variety of objects of surveillance, automobiles, containers, homes, offices, factories, hospitals, warehouses and factory machinery, etc., for surveillance purposes. By monitoring the communication conditions between a plurality of communication nodes which are installed to the outside or inside of an object to be monitored, it is possible to detect if the deformation of the object (for example, opening or closing door) has occurred, or if an illegal person has entered the container. To wit, this invention can provide a general security system which is applicable to any kind of object to be monitored. Among them, the following will now be described mainly with reference to cargo containers.

BRIEF DESCRIPTION OF THE DRAWINGS

FIG. 6(A) shows an initial network graph matrix corresponding to the network structure information immediately after the door is closed according to the first preferred embodiment.

FIG. 6(B) shows an initial network graph matrix corresponding to the network structure information when the door is opened according to the first preferred embodiment.

FIG. 12(A) shows a rough sketch of an initial network structure, and FIG. 12(B) shows a rough sketch of a network structure in the monitoring mode.

FIG. 15(A) shows an initial network graph matrix which is an initial network structure generated immediately after the container door is closed, and FIG. 15(B) shows the current network graph matrix.

FIG. 16(A) shows a network graph matrix which is formed by only active nodes comparing with FIG. 15(A), and FIG. 16(B) showing a network graph matrix which is formed by only active nodes comparing with FIG. 15(B).

FIG. 18 shows a rough sketch for transmitting and receiving flows for UWB according to the second preferred embodiment.

FIG. 20 shows a rough sketch of data communication according to the second preferred embodiment.

DETAILED DESCRIPTION OF THE INVENTION

Figure 1:
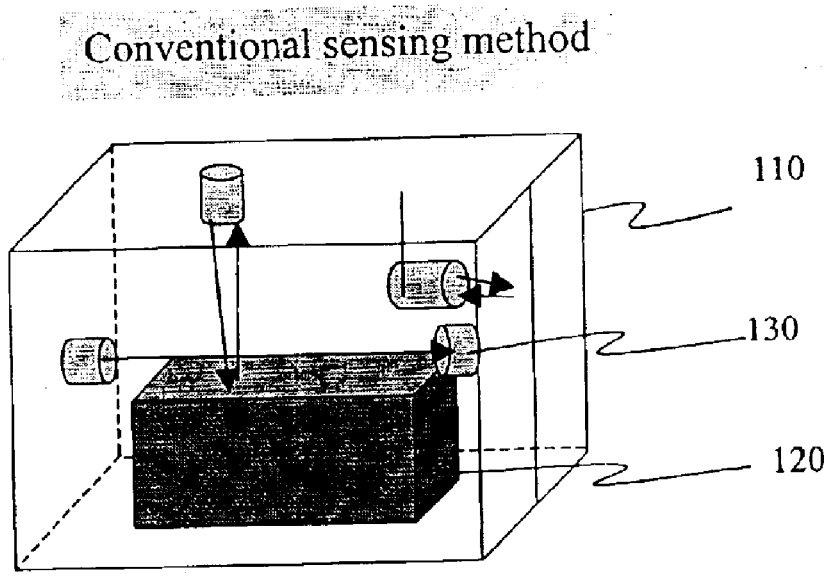
FIG. 1 shows a rough sketch of a sensing method according to a prior art.

In this section we shall explain several preferred embodiments of this invention with reference to the appended drawings. Whenever the size, materials, shapes, relative positions and other aspects of the parts described in the embodiments are not clearly defined, the scope of the invention is not limited only to the parts shown, which are meant merely for the purpose of illustration.

Definitions

Terms used in the specification shall have the below specified definitions.

1) Communication Node

Communication node is a node in a communication network. In the self-organizing wireless network which is applied in the first preferred embodiment, the network comprises a plurality of communication nodes, each of which communicates only with the neighboring nodes by low-power electric waves. To communicate with other nodes, which are located at remote places, the neighboring nodes relay the receiving data to the neighboring nodes. The relaying time from a node to another node is called the HOP count.

In the second preferred embodiment, the distance between nodes are measured by the data communication and distance measuring method.

2) Communication Device:

A communication device functions as a parent node which is one of a plurality of nodes in the communication network, and it is a specific node having a communication function and a memory function.

3) Node Distribution Information

Node distribution information is the location information indicating where a node is located among other nodes in a communication network. Node distribution information can be expressed by a relay count to represent how many relays are needed to communicate between one node and the other nodes in the network. Further, node distribution information can be expressed by a distance data between one node and other nodes. Further, it can be expressed by whether a wireless communication carrier (electric wave, beam, or sound) has, or has not reached from one node to the other nodes. According to the first preferred embodiment, employing the self-organizing wireless network, the node distribution information can be defined by a data relay count (HOP count) when a data is sent from one node to the other nodes. To wit, node distribution information is the same as the HOP count table, which comprises data relay counts between one node and other nodes. According to the second preferred embodiment, node distribution information is defined by distance data between one node and other nodes in the network. A communication can be established between the nodes in which the distance has been measured. In the node distribution information defined by whether a carrier has, or has not, has been received, a communication can be established when the carrier from the other nodes have been received. From the node distribution information, all of the node distribution information in all nodes can be defined as a network graph matrix which will be explained later. To wit, each row and each column represent the node distribution information.

4) Status Information of Object

Status information of object to be monitored is at least one of the following types of information: (1) deformation in the object to be monitored, (2) position of the object of surveillance, (3) distribution of the proximate articles in the vicinity of the object to be monitored, (4) movements of the proximate articles in the vicinity of the object to be monitored.

5) Network Structure Information

This is the information about the entire wireless communication network structure comprised of a plurality of nodes attached to the object to be monitored. This network structure information can be obtained by combining the node distribution information of each node, which may be expressed as a network graph matrix.

6) Network Graph Matrix

The entire structure of the wireless communication network comprised of a plurality of nodes attached to the object to be monitored can be expressed as a matrix using the link status between any two nodes as elements. Here, the link status between nodes means the inter-nodal communication status including the distance between the nodes, a flag dictating whether or not a message can be transferred directly between nodes, the communications speed between nodes, the electrical field strength at a receiving node generated by the electrical waves.

In the network graph matrix, according to the first preferred embodiment, the element (s, p) is expressed by "1" if the direct communication between node s and node p can be established without relaying the data (HOP count is zero) by other nodes, and by "0" if the direct communication can not be established and the relaying by other nodes is needed (indirect communication). According to the second preferred embodiment, the element (s, p) in the network graph matrix is expressed by a distance data between node s node p. In the surveillance system, according to the present invention, the system monitors if there is any change in the object to be monitored by comparing the initial or reference network graph matrix of the object and a monitoring network graph matrix under monitoring in predetermined time intervals. The initial network graph matrix will be the one generated at the time a container starts, and it should remain the same if there is no change during the time of transportation to the destination. If there are any changes in the container, they will be detected as a change in the network graph matrix.

7) Fingerprint

Since the distribution of nodes differs for each network, which represents a network graph matrix, the network graph matrix showing the network structure can be used as a specific fingerprint to identify each network. Accordingly, in some instances, the network graph matrix will be referred to as the fingerprint. A node ID number for each node in the network graph matrix can be randomly generated, and if data for the corresponding node number is included for each row and column of network graph matrix, even if another network were to duplicate the exact distribution of the nodes, the network graph matrix would be completely different and unique for each network to thereby serve as a true fingerprint.

Principal to Detect an Abnormality by the Surveillance System According to the Present Invention The present invention is applicable to a wide variety of objects of surveillance, automobiles, containers, offices, warehouses, factories, houses, etc., for surveillance purposes. To wit, the surveillance system monitors an object to be monitored and the approximate area in the vicinity of the object (the inside and outside space of the object to be monitored). In order to shorten the explanation, the following explanation is limited to the application for a freight container (referred to as a container hereafter) used for ocean freights, but it is not an intention to limit the scope of the invention. The subject container is such that it may be loaded or unloaded interchangeably in freight trains, trucks, cargo ships, and aircraft, and it is equipped with fixtures that facilitate its raising or lowering by loading equipment. In addition to being strong enough to accommodate stacking, it is constructed to prevent slipping when stacked. Further, it may have a door or lid to accommodate lowering or stacking cargo into the container. According to the present invention, an abnormality in a container is detected by the "Hagoromo" method. The "Hagoromo" method is defined as a sensing method, in which, by monitoring the link status between a plurality of communication nodes attached to an object to be monitored, the method detects any movement of the object and a status information of the proximate area in the vicinity of the object, then the method uses the link status information as a fingerprint which is unique to the object to be monitored.

The detection of dangerous materials is likely to be affected by such factors as how the cargo is loaded, the type of material of the dangerous article, and its packaging. Thus, rather than designing a conventional sensor appropriately to detect dangerous materials according to the properties of such dangerous materials, the method for detecting any "movement" which would occur during the act of secretly hiding dangerous materials in the container, would be a universal defection method for detecting abnormalities that are unaffected by the nature of the dangerous material being detected. Considering that detecting the "movement" in containers having various structures, and made from various materials, rather than detecting the dangerous material itself, the greater universality would be achieved by attaching a communication network, having one or more communication nodes in the container which communicate with each other, to thereby detect "any movement which may occur between the communication nodes", a method that is unlikely to be influenced by any of the materials or structure of the container.

There is also the possibility that rather than dangerous material being secretly hidden in a container, that a bogus container, holding dangerous material, could be switched with the original container. In order to handle this type of container swapping, it would be necessary to affix some specific information to the container, comparable to identifying by a human fingerprint or voice print, that is also registered in the surveillance center, and then by comparing the information affixed to the container with that registered in the center, it would be possible to detect any swapped, bogus container. The implementation of this, the specific information affixed to the container and its registration at the center should be handled automatically without human intervention, because people frequently leak specific information such as passwords.

Based upon the foregoing analysis, it is concluded that the following is an ideal means of addressing the issues mentioned above.

The object, such as a cargo container, being monitored by a surveillance system according to this invention would be equipped with a plurality of communication nodes, that would communicate with each other. It is possible to detect the "movement of communication nodes distribution" which has occurred by the "movement of object to be monitored". From the detected "communication nodes distribution", therefore, it is possible to obtain the characteristic status information which can identify the object to be monitored.

The "movement of an object to be monitored", and the "movement of communication nodes distribution" will be explained as follows. From a deformation of object or a displacement of an object, the movement of an object can be detected as follows. A plurality of nodes having a communication function (communication nodes) are distributed in the object. Each of these communication nodes communicates with each other, and generates a node distribution information. By combining all of the node distribution information of each node, a network structure information can be generated, which shows a structure of the communication network provided with a plurality of nodes.

For example, a certain communication node is selected as the central node, then the distance to the other nodes from that central node is determined by calculating the delay time in which the communication is established between the central node and other nodes. The distance data is then reported to the central node. In this example, the node distribution information is expressed by the distance data from the central node to other nodes. Another way to obtain the network structure information is that, some nodes having known coordinates are assigned as the standard nodes, the distance between the standard nodes and other nodes are measured, and then the coordinate of each communications node are determined by the intersection points of circles or spheres that use those measured distances as radii.

Yet another way would be to not establish a central node or any base nodes, but to detect a link information to link with other nodes. This link information can be expressed by a code expressing whether or not direct communication is possible, by a relay count which represents how many times the relaying is required for each node to communicate with the other communication nodes, by the transmission power to achieve direct communication, or by the distance data calculated by the communication time. A node distribution information is obtained by assembling the link information which expresses the relationship between a node and other nodes. Further, the network structure information is obtained by assembling the node distribution information of each node to generate a specific status information about the object to be monitored. Thus, as far as the information of communication nodes distribution is specific to the object to be monitored, or if unique numbers are assigned to the communication nodes specific to the object, the obtained network structure information can be a specific status information that can identify the object to be monitored.

According to the first preferred embodiment of this invention, the link information mentioned above can be expressed by whether a communication between the two nodes is established directly, or if it requires to be relayed by other nodes. According to the second embodiment, the link information can be expressed by the distance between the node, which is measured by UWB electric wave.

One way to detect the node distribution information is disclosed in U.S. Pat. No. 6,028,857, which discloses a communication network provided with a self-organizing network, which is applied in the first preferred embodiment of the present invention. This self-organizing network is a kind of a relay system to communicate between a plurality of nodes, each of which can communicate only with their neighboring nodes by low-power electric waves. Each node is provided with relaying counts to all of other nodes according to the self-organizing network. The relaying count is defined by how many relays are needed to send a message to the other nodes. A HOP table is established by the relaying counts of each node. This HOP table is the node distribution information.

Further, another way to obtain node distribution information is to measure the distance between the nodes using Ultra Wideband (UWB) according to the second preferred embodiment of this invention. With this UWB technology, the distance between a plurality of nodes which are installed in a closed space can be measured, for example, a freight container. Each node transmits a measuring signal of UWB electric wave to measure a distance to other nodes. The transmitter node receives the response signal from other nodes, and the distance between the transmitter node and other nodes are calculated by the time lag between the time of transmitting the signal and the time of receiving the response signal. Based on the calculated distance, a network graph matrix is generated which is unique to the container. The factor of the network graph matrix is a distance data between the nodes. This network graph matrix can be a fingerprint of the container. If an unauthorized person enters into the container, or if an illegal article is loaded in, then the electric transmitting in the container will be affected, and it may happen that the measuring of the distance is no more possible. If a container door is opened or closed, the nodes distance to the door is changed and the network graph matrix is changed accordingly.

System Configuration

Figure 3:
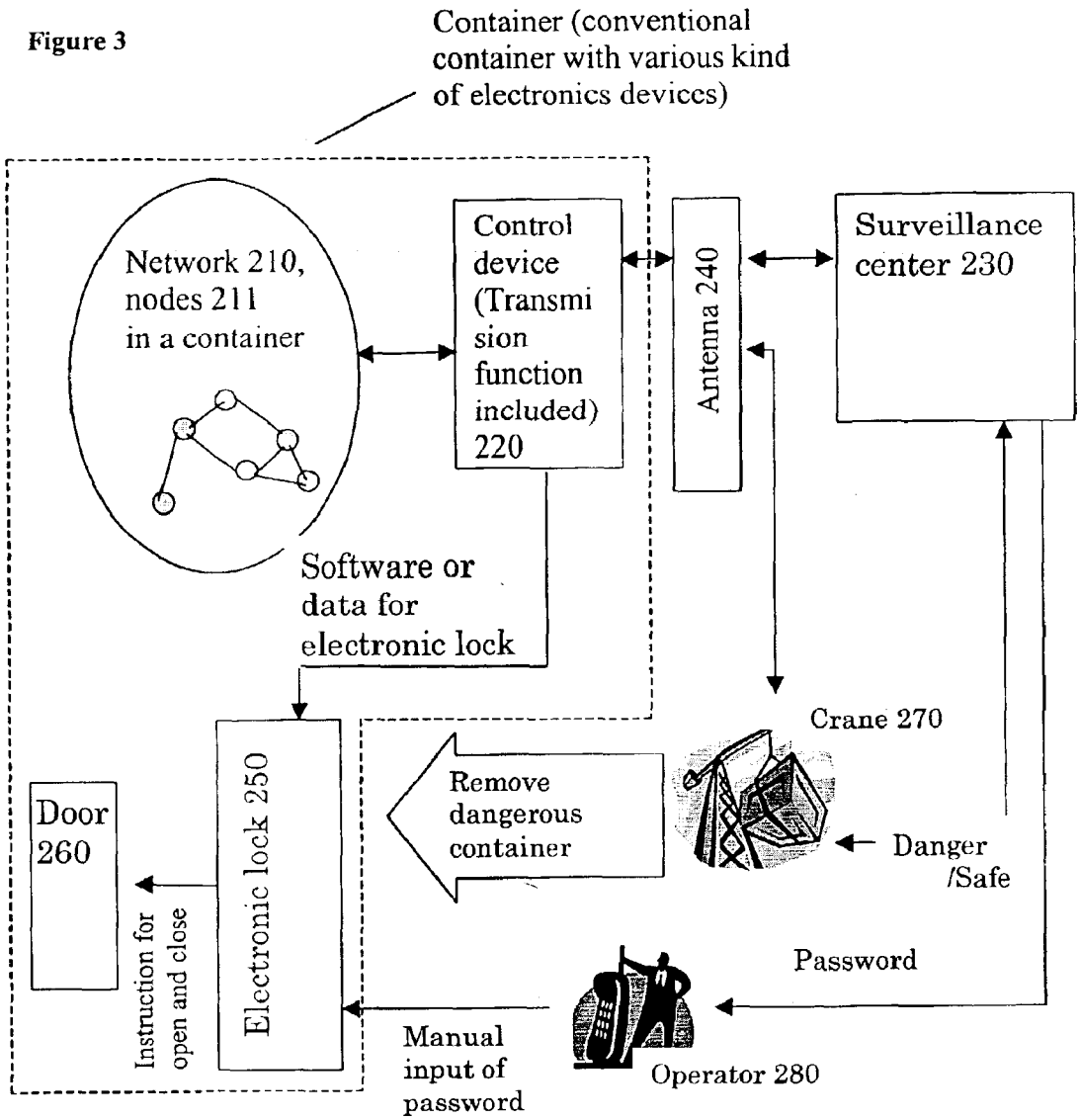
FIG. 3 shows the system structure for an embodiment of the surveillance system for containers according to this invention.

FIG. 3 shows a system structure for the surveillance system 200 according to this invention. The container 201 is equipped with a communication network 210 which comprises a plurality of communication nodes 211 installed on the inner walls. Using such a configuration, the container is monitored by the "Hagoromo" method which was mentioned above. A communications network 210 will be described in detail below. The status information, to wit, a network structure of the network information which is detected, is sent to surveillance center 230 via control device 220 and outer antenna 240. In surveillance center 230, if an abnormality is detected based on the status information sent from container 201, then the center sends an instruction to the operator 280, for example a crane to move the container 201 to a special position in the container yard for a detailed inspection. If no abnormality is detected at the center 230, the center will send a software to release the electronic lock unit 250 wirelessly, and the software is installed in the electronic lock unit. Then, a password for releasing the lock unit is sent to electronic lock unit 250 via a separate route. The password is then input into electronic lock unit 250 by operator 280, and the door 260 of container 201 is opened.

Figure 29A:
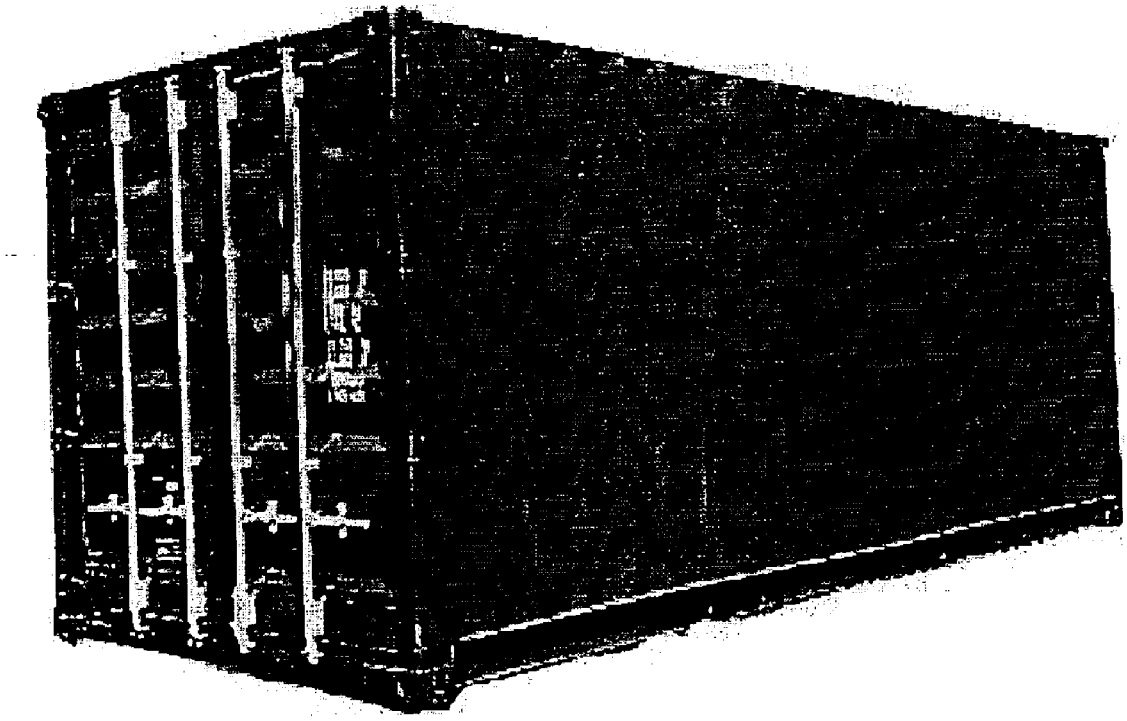
FIG. 29(A) shows an outer view of a conventional container.
Figure 29B:
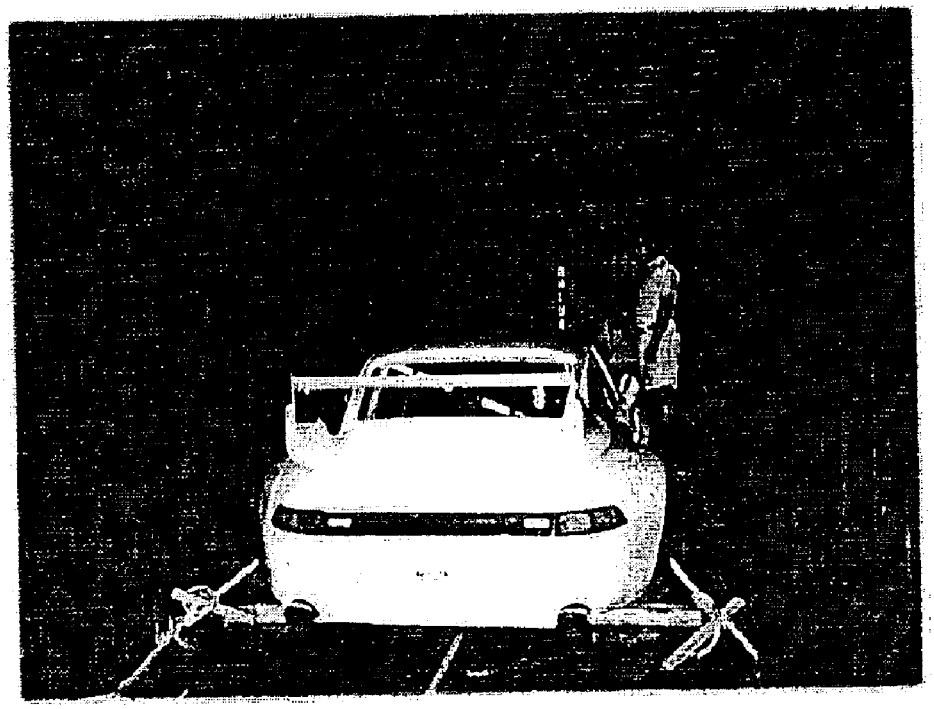
FIG. 29(B) shows an inner view of the same.

The inside of the container 201 is a difficult area to wire with cables. As shown in FIGS. 29(A), and 29(B), the inner wall is bellows shaped, and it is made with a folding metal. This configuration of the wall makes it difficult to fix cables along the wall. If the cabling is fixed over the inner folding wall, the cables are easily damaged when the cargos are loaded in and out. It is, therefore, necessary to fix a plurality of communication devices for communication network 201 (communication nodes) within the ditches of the folding wall by adhesive or bolts, and send the communication data wirelessly to control device 220 provided in the container to eliminate the wiring in the container. Each communication device mentioned above is activated by a battery installed in the container. If each node has a battery respectively, the problem is that the battery capacity is not enough to keep the communication node active, and the battery replacement for each node requires many man-hours. If there is a big battery for each node, which can keep the node active, then each node can have such a battery. If there is no such battery, then the alternative will be that control device 220 holds a large volume battery which keeps all of the nodes active, and the battery power will be shared with each node by connecting the nodes with the large volume battery installed in the control device 220. When the wiring cables are installed for sending the battery power to each node, the wiring should be installed within the ditches of the folding inner wall to lower the possibility of being damaged during loading.

Further, since the wiring environment in the container is not good, if the sensors need to be installed at specific positions on the wall, the installation cost of sensors will become too high. The installation positioning of sensors can be random not only because of the installation cost, but also because it is better for forming the higher security system. It is, therefore, necessary to have flexibility to select the installation position of the communication device (communication nodes) in the container. As mentioned above, for forming a communication network in a container, which collects the sensing data from the communication nodes and which are installed at random positions, and sends them to the control device, the communication network has a self-organizing network function which will be explained later.

Further, the container walls (side plate, ceiling, door, and floor) are made with aluminum or steel having approximately 2 mm thickness, but it is still possible to make a hole by a drill or burner. Specially since the recent containers are built lightly, it is easier to make such holes than in the previous types of containers. It is, therefore, necessary to detect such activity other than only to detect the opening or closing of the door. In order to detect the action of making a hole on the side plate, ceiling, door, and floor of a container from the outside by a drill, burner or laser, it is necessary to install vibration sensors and temperature sensors on the wall. One of the examples for vibration sensors is model D7F-C01 made by Omron Corporation. This type of vibration sensor can be modified to meet the temperature range for such purposes. It can be selected from the sensors which are relatively thin so that they can be installed within the ditches of the folding wall by bolts or an adhesive. A thin vibration sensor is disclosed in the Japanese patent publication Hei 6-162353 (made by Omron Corporation). The thickness of this sensor is relatively thin, and it can collect the vibration of the container wall by the bottom base which is attached to the wall.

The temperature in a container is varied between −30 degrees C. and +80 degrees C. For the sensors and the communication nodes (the details will be explained later). It is necessary, therefore, to install a battery, micro computers, and the peripheral circuit which can be operable for a long period in a variety of temperature ranges. One of the examples is model BR2477A (high temperature resistant type fluoride black lead lithium battery) made by Matsushita Electric Works. The operable temperature range of this battery is between −40 degrees C. and +125 degrees C., and the output voltage is 3V. Further, one of the examples of the micro computer applicable for communication nodes and control device 220 is series M32R/ECU made by Mitsubishi Electronics Company. The operable temperature range of this micro computer is between −40 degrees C. and +80 degrees C., and the power voltage is 3.3V.

If this micro computer is kept activated continuously by the battery of BR2477A, the battery will be consumed in a short time. It is, therefore, necessary to supply the electric power at interval time periods to the communication nodes, the control device 220, and the sensors connected to them, all of which use micro computers. These interval time periods can be controlled by a low powered time circuit. The temperature range of the communication nodes, the sensors and the control device must be set wider, and the battery having a wide temperature range must be used in the system according to this invention. Some of the communication nodes are provided with vibration sensors to detect any drilling for making a hole in the wall. The communication nodes can also be provided with temperature sensors to detect burner heat for making a hole in the wall.

Figure 4:
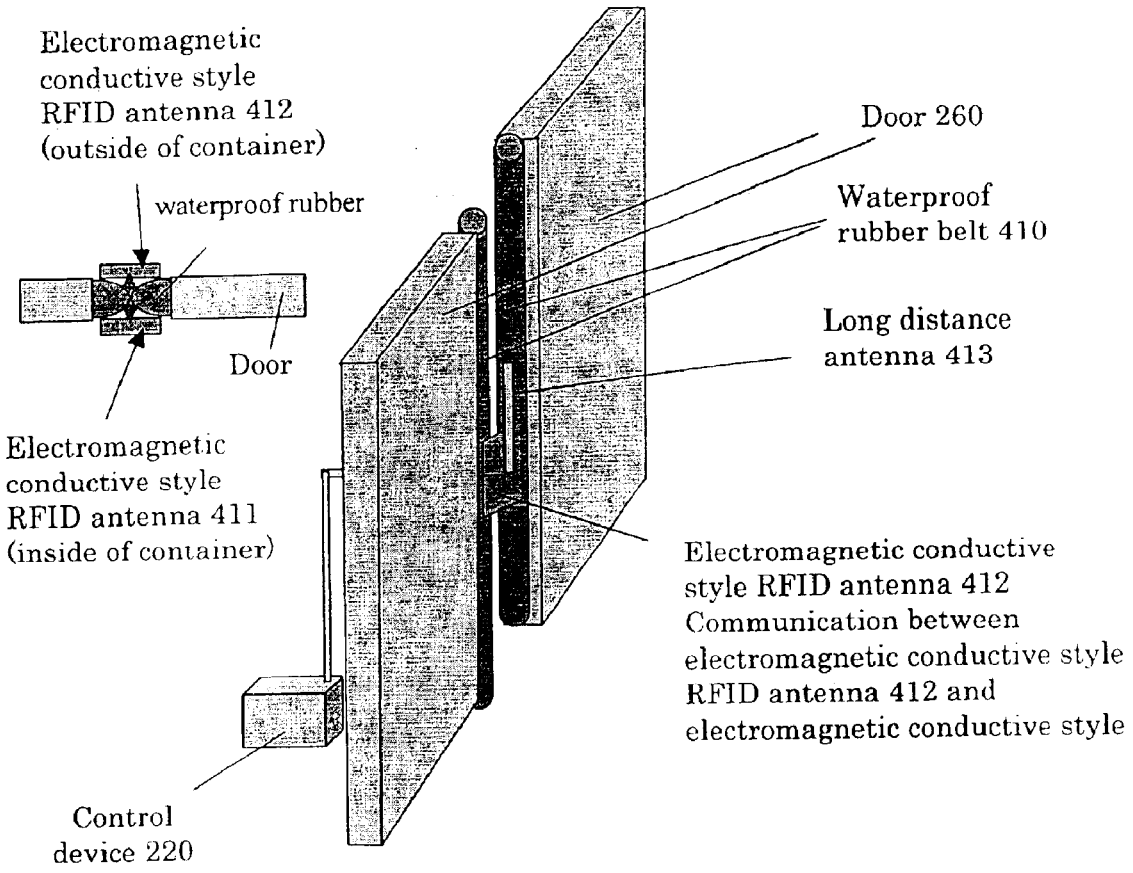
FIG. 4 shows how to communicate between an outside and an inside of a container.

As shown in FIG. 3, the communication nodes 211 are fixed at random positions on the inner walls of container 201. In order to detect the opening or closing of the door of the container, at least one communication node must be installed in each door 260, 260. As shown in FIG. 4, electromagnetic conductive style RFID tag 411 connected with a wire cable to control device 220 is attached to a waterproof rubber belt 410 of the inner side of the container. Electromagnetic conductive style RFID antenna 412 is attached to waterproof rubber belt 410 of the outer side of the container. Electromagnetic conductive style RFID tag 411 and the electromagnetic conductive style RFID antenna 412 are facing each other sandwiching the waterproof rubber belt 410 when the door is closed. With this configuration, electromagnetic conductive style RFID tag 411 and electromagnetic conductive style RFID antenna 412 can communicate with each other by electromagnetic waves even if the doors 260, 260 are closed and waterproofed by water roof rubber belt 410. Electromagnetic conductive style RFID antenna 412 is connected with a wireless transceiver which is not shown in the drawing. The transceiver will relay the communication between the electromagnetic conductive style RFID antenna 412 and a long distance antenna 413 for long distance communication. With the wireless transceiver which is not shown, the information in the container will be sent to control device 220, electromagnetic conductive style RFID tag 411, electromagnetic conductive style RFID antenna 412, the wireless transceiver which is not shown, long distance antenna 413, and to a remote location from the container. The information from the outside will be transmitted via the reverse direction.

Communication Network in the Container

Figure 2:
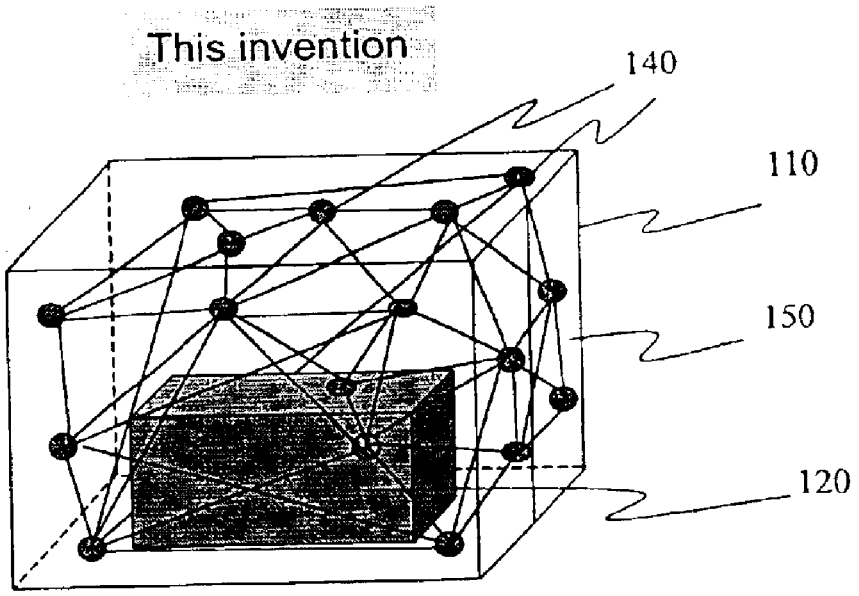
FIG. 2 shows a rough sketch of a sensing method according to this invention.

A plurality of communication nodes 140 shown in FIG. 2, which have wireless communications capabilities, are attached inside of the container to the door, walls, or ceiling, and they form communication network 500, 500'. At a specified time interval, this communications network generates network graph matrix 600, 600' shown in FIG. 6(A) FIG. 6(B), which expresses a network structure information of this network. The first graph matrix generated immediately after the door is closed will be a unique information of the container. Communication network 500, 500' and network graph matrix 600, 600' will be explained in detail later.

Control device 220 for container 1 is located inside of the container, and it functions as one of the communication nodes, which communicates wirelessly with the various communication nodes in the communications network. Upon receiving a specific command from the control device 220, all of the nodes in the communications network provided in the container to be monitored will self-organize for forming a communication network within the container. The self-organization means that it generates a node distribution information which defines the nodal relationship of each node with all of other nodes. By using the node distribution information in the same manner as HOP count table disclosed in U.S. Pat. No. 6,028,857, the communication route between the communication nodes can be determined. Each node reports out it's own node distribution information resulting from self-organizing to the other communication nodes. In each node, the network graph matrix is generated by assembling all of the received node distribution information. Because of this process, the generated network graph matrix in all of the nodes should be identical. When the control device 220 issues a command for initializing the communications network in the container, all of the nodes generate an initial network graph matrix, which will be memorized by each communication node. Accordingly, the control device 220 also memorizes the initial network graph matrix. The control device 220 has wireless transceiver capabilities, and it can communicate with the outside devices by electromagnetic conductive communication via electromagnetic conductive style RFID tag 411 and electromagnetic conductive style RFID antenna 412 which sandwiches the waterproof rubber belt 410.

When the loading of the container has been completed, the control device 220 sends a command to the communication nodes to initialize the nodes after the door is closed and the control device receives the initiation command from the outside. Then, control device 220 sends a command to the communication nodes to generate a network graph matrix. The initiation command from a dedicated unit provided outside of the container is wirelessly received by the control device via long distance antenna 413. After this step, each node 211 begins to communicate with all of other nodes to generate the network graph matrix 600. When control device 220 receives the network graph matrix, it transmits the received network graph matrix wirelessly to the surveillance center 230 by the electromagnetic communication means shown in FIG. 4. Then, the surveillance center 230 records the received network graph matrix as a unique data of the container to identify the status of the container. To wit, the first network graph matrix 600 generated after the door is closed, will be a unique information of the communication network 210 of the container to be monitored.

The network graph matrix mentioned above is generated at a predetermined time interval after the container departs from the loading yard until it arrives at the final destination.

Detection of Abnormality in the Network

The detection in the communication network 210 is performed by the following two methods. According to the first preferred embodiment, a link information between each pair of nodes is defined by HOP count which is a relaying count in a self-organizing communication network. According to the second preferred embodiment, a link information is defined by a distance data between each pair of nodes which is measured by UWB (Ultra Wideband) electric wave. Using the link information as a matrix factor, then, a network graph matrix is generated. An initial network graph matrix is generated immediately after the door of a container to be monitored is closed, and the initial network graph matrix is, then, recorded in the surveillance center and each node is a part of the generated fingerprint. After the initial network graph matrix is recorded, for monitoring purposes, a plurality of network graph matrixes are generated periodically and compared with the initial network graph matrix. In the comparison process, if more than a predetermined number or rate of the link information between a pair of nodes in the network graph matrix is different from the recorded fingerprint, then the surveillance center or the control device will judge that an abnormality has occurred in the container. Further, in the abnormality instance, if the link information satisfies a predetermined condition, then the surveillance center or the control device will judge that the communication network 201 was attacked. The predetermined condition includes the situations, for example, that non-functioning nodes increased rapidly in a short time frame, or that more than the number of the nodes which have been changed exceed the threshold value. If an attack is detected, the fingerprint is deleted to prohibit the reproduction of the fingerprint. Since the fingerprint of the container to be monitored was deleted in the surveillance center, it is therefore, no longer possible to compare the detected network graph matrix, and this makes it impossible to hide the abnormality of the container.

Surveillance Process According to this Invention

Figure 22:
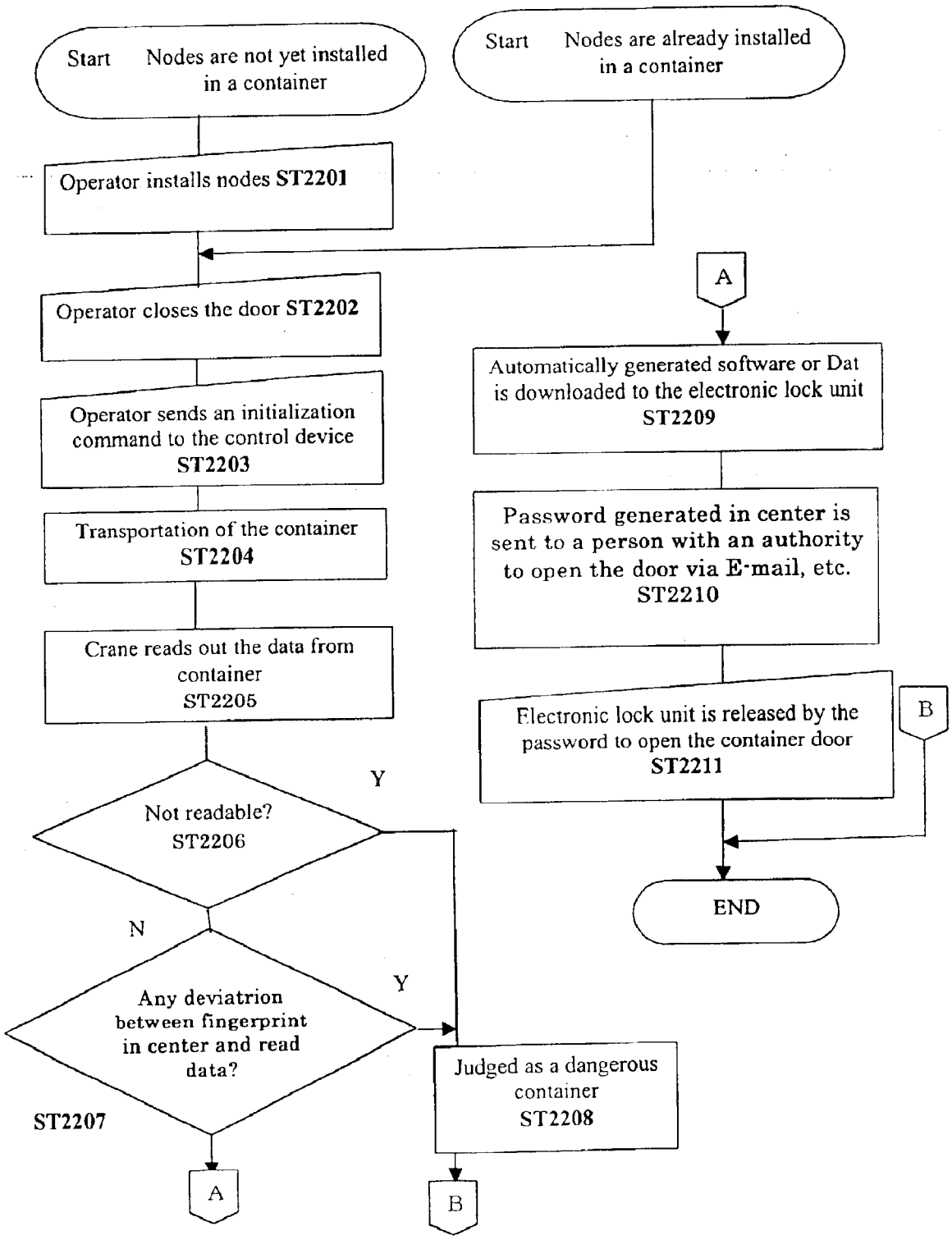
FIG. 22 shows a flowchart in which a fingerprint is generated and registered after a plurality of communication nodes are installed in a container, the container is transported, and the container door is opened at the destination.
Figure 23:
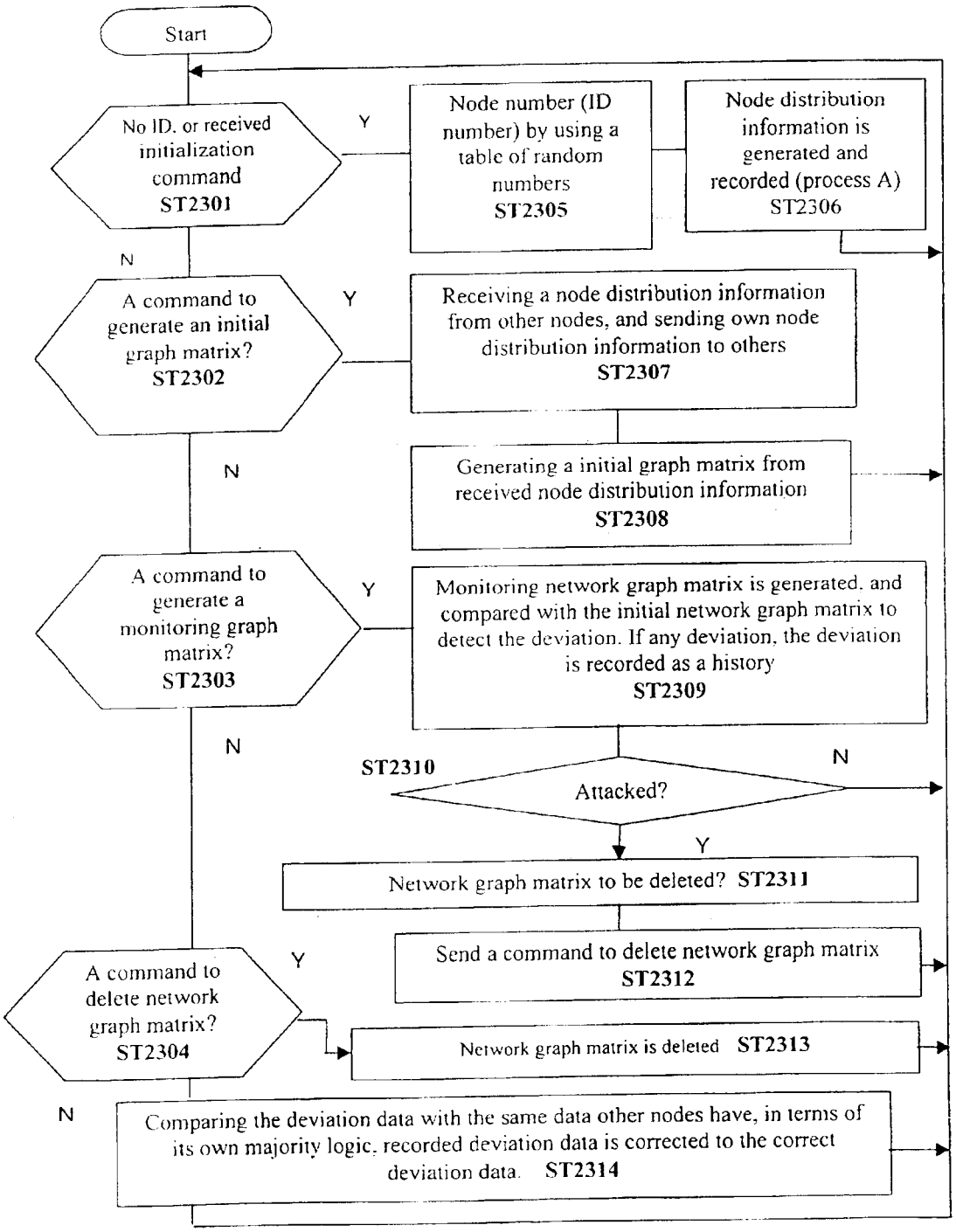
FIG. 23 shows a flowchart of processing in each node according to the present invention.
Figure 24:
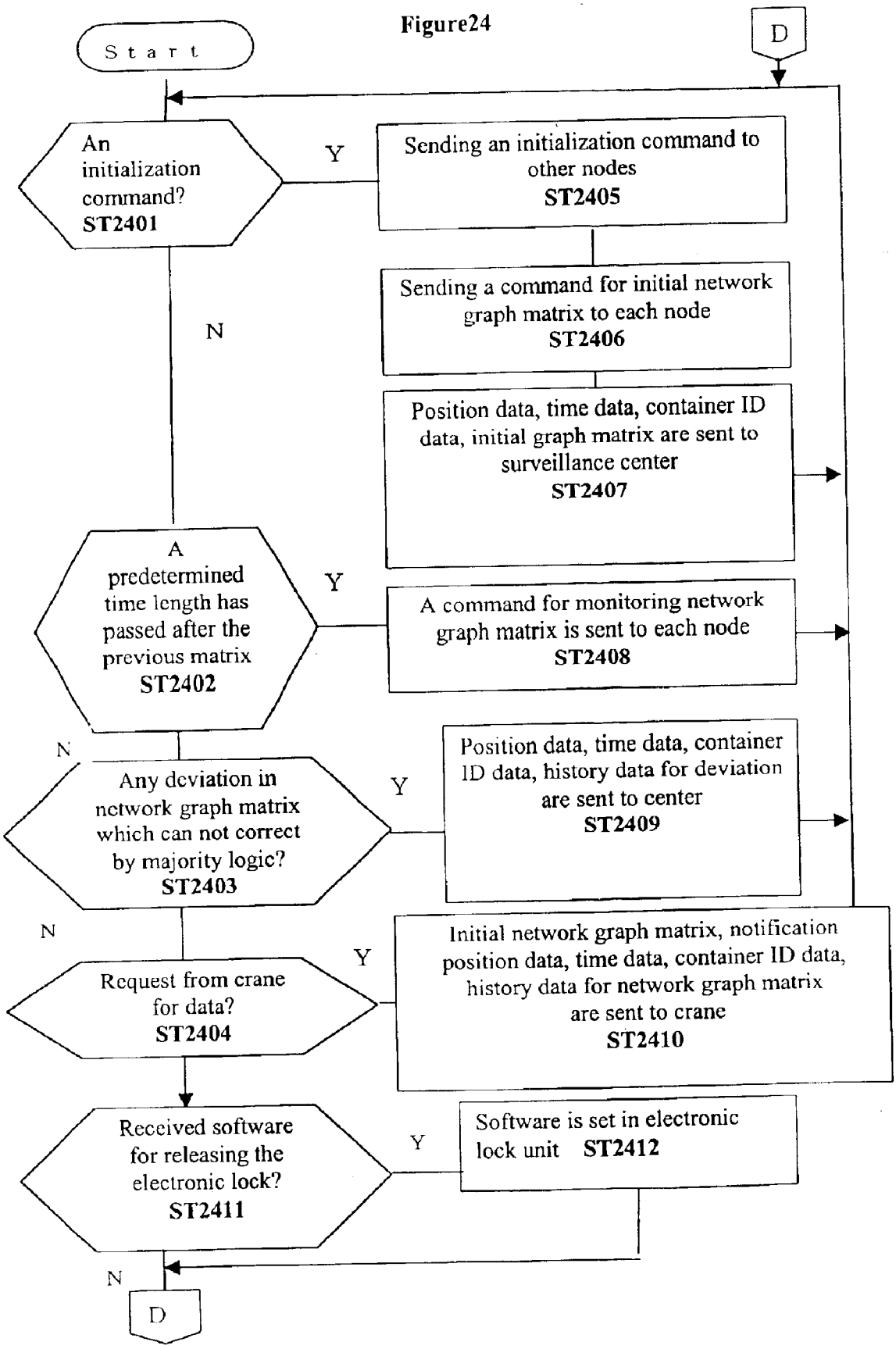
FIG. 24 shows a flowchart of processing in control device 220 according to the present invention.
Figure 25A:
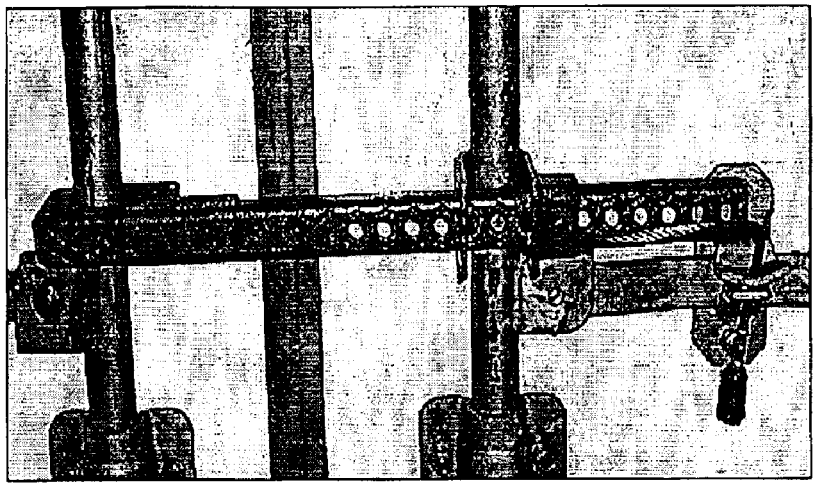
FIG. 25(A) and FIG. 25(B) show rough sketches of a mechanical conventional seal.
Figure 25B:
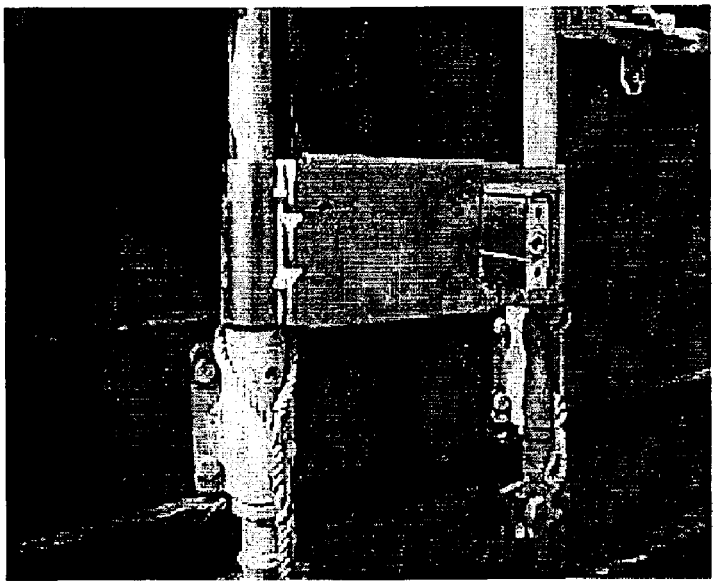
Figure 26A:
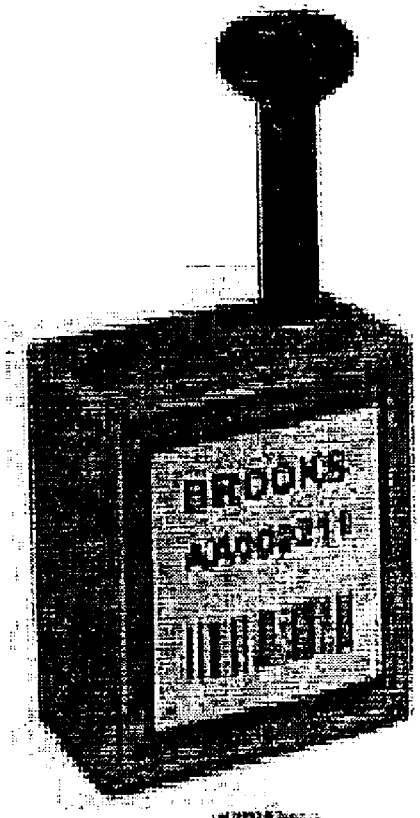
FIG. 26(A) and FIG. 26(B) show rough sketches of electronic a conventional seal.
Figure 26B:
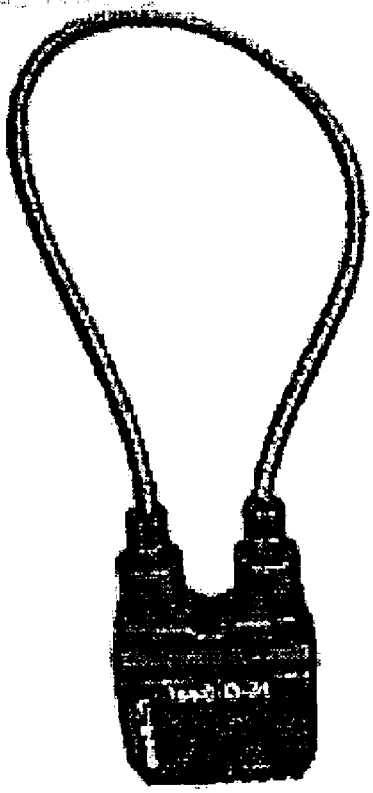
Figure 27:
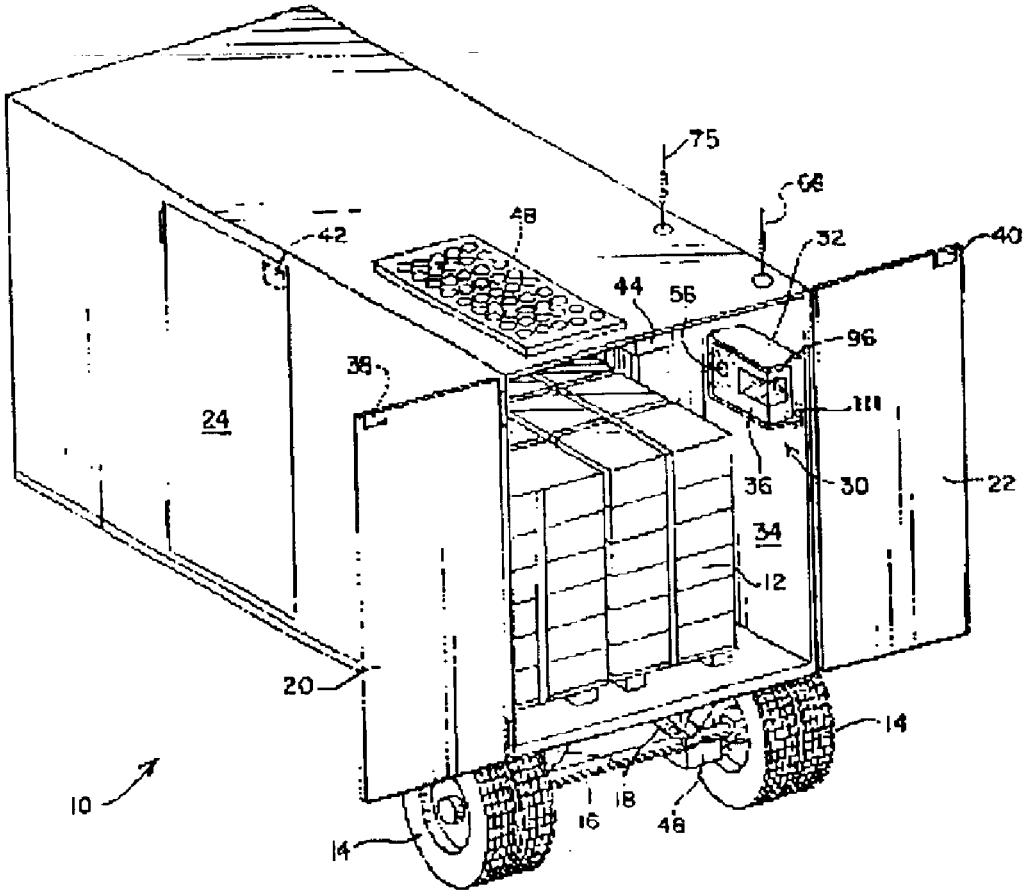
FIG. 27 shows a conventional seal as an example disclosed in U.S. Pat. No. 4,750,197.
Figure 28:
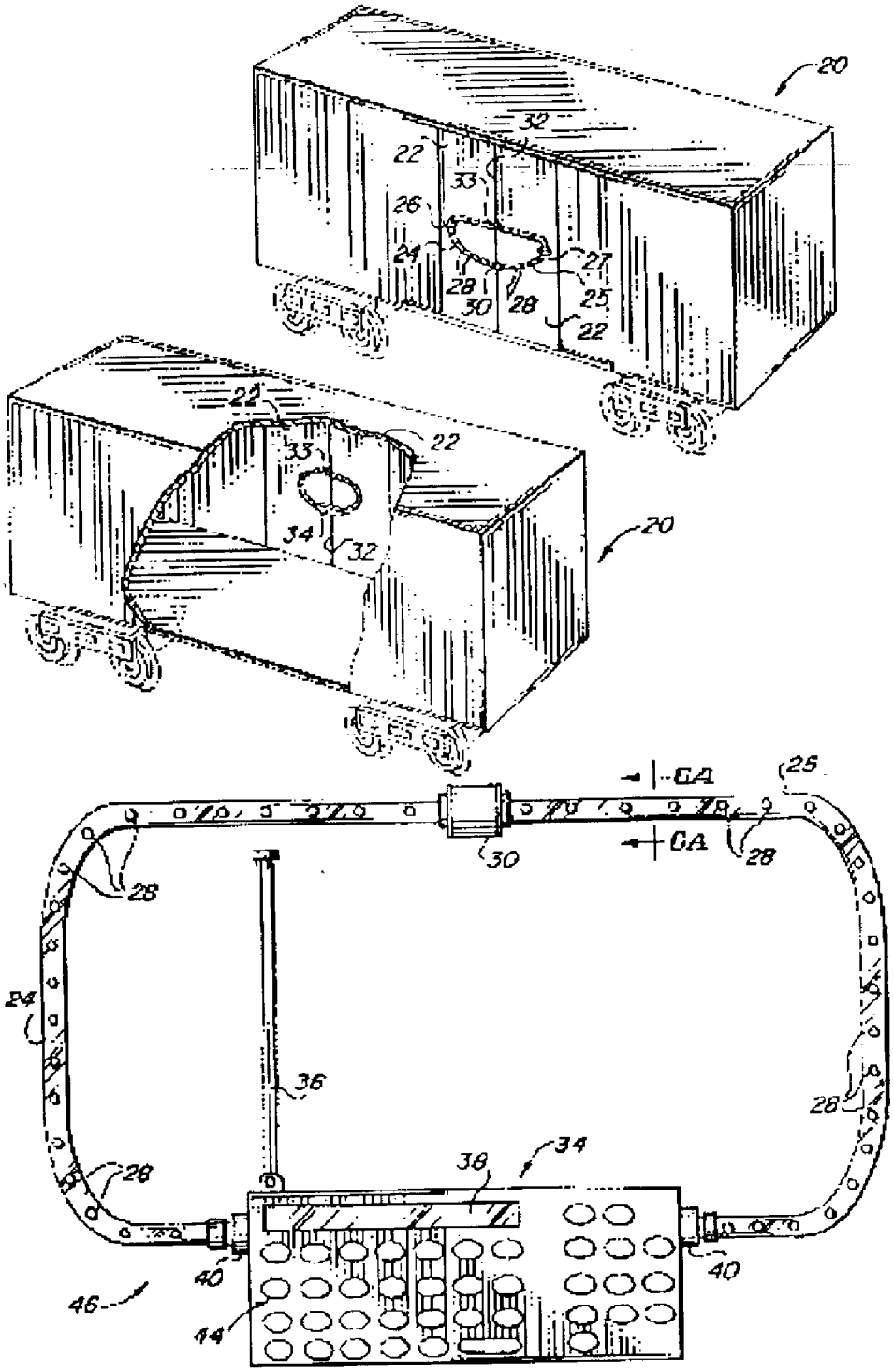
FIG. 28 shows a conventional seal as an example disclosed in U.S. Pat. No. 5,615,247.

FIG. 22, FIG. 23, and FIG. 24 show the flowcharts of a surveillance process according to this invention. The flowcharts are for both the first and second preferred embodiments. FIG. 22 is a flowchart showing the process for installing the communication nodes in a container, generating and recording a fingerprint of the container, transporting the container, and opening a door of the container at the destination. FIG. 23 is a flowchart showing the process at each node according to this invention. FIG. 24 is a flowchart showing the process in the control device 220.

As shown in FIG. 22, an operator installs the communication nodes in a container to be monitored, by control device 220, and electromagnetic style REI antenna 412, a transceiver, and long distance antenna 413 (ST2201). The operator installs the devices and units, or if they are already installed, then the operator replaces the batteries, performs the operational confirmation, and the necessary repair. If the operator of a container transportation company does not have such a responsibility, the employees of the shipper will perform the preparation mentioned above. When the preparation is completed, the container is closed temporarily and the container is forwarded to the loading place of the shipper. (If an empty container is transported, since there is no shipper, forwarding process will be omitted.)

When the loading into the container is completed at the shipper's loading yard, then the loading operator will close the door of the container (ST2202).

After the above process, the operator sends an initialization command to the control device 220 (ST2203). The operator issues this command by his wireless unit, and this command is a wireless signal for the initialization command designating the container ID number. This signal is directly received by antenna 240 (long distance antenna 413) shown in FIG. 3, and forwarded to control device 220 via the route previously explained. If the wireless unit is a cellular phone, an initialization request is transmitted to the control office along with the container ID number, then the control office will wirelessly transmit the initialization command using the received ID number. The transmitted initialization command is received by container 240, and forwarded to control device 220 via the route mentioned above. The control device has its own container ID number, and determines if the received initialization command is for its own container or not by referencing the ID number attached to the initialization command. If the received ID number matches its own ID number, then the device performs the initialization process. If the received ID number does not match its own ID number, then the initialization command will be neglected. (After the control device receives the initialization command, the process shown in FIG. 24 is performed. Simultaneously, the communication nodes will perform the process shown in FIG. 23.)

Control device 220, which receives the initialization command, verifies if the judgment at ST2401 is YES, and then the control device issues the initialization command to all the other nodes as shown in ST2405.

Each node will perform the process shown in FIG. 23. When a node receives the initialization command from the control device, and the judgment at ST2301 is YES, then the process is performed at ST2305. At ST2305, the node determines its own node number (ID number) by using a table of random numbers. The digit size of the ID number must be large enough so that the possibility of assigning the same ID number to other nodes in the container can be avoided.

At ST2306, as process A, a HOP count table is generated and recorded, which defines the HOP counts to all of the other nodes according to the first preferred embodiment. The HOP count table is a set with data which indicates the relaying counts of each node to all of the other nodes. According to the second preferred embodiment, a set of distance data between each node and all of the other nodes is generated and recorded.

Further, the control device performs ST2406, after ST2405 shown in FIG. 24, in which the control device indicates to each node to generate an initial network graph matrix.

When each node receives the initialization command to generate an initial network graph matrix, the judgment at ST2302 in FIG. 23 will be YES, and ST2307 will be performed. Each node receives a set of HOP counts which is node distribution information according to the first preferred embodiment, and each node receives a set of distance data which is a node distribution information according to the second preferred embodiment. Further, each node sends its own node distribution information to all of the other nodes.

When ST2307 is completed, each node generates a network graph matrix by assembling the received node distribution information sent from all of the other nodes (ST2308). The reason for generating the node distribution information at each node is that it makes it still possible to generate the network graph matrix in any of the nodes, even if some of the nodes do not function.

The control device sends the initial network graph matrix obtained at the departure time, a position data received from a GPS receiver, a time data obtained from a clock unit, and the ID number of the container to the surveillance center 230 after they are encrypted (ST2407). The initial network graph matrix, according to the first preferred embodiment, is shown in FIG. 6(A), and the initial network graph matrix, according to the second preferred embodiment, is shown in FIG. 15(A).

After the container departs from the loading yard, the control device periodically sends a monitoring command to generate a monitoring network graph matrix to the nodes (ST2402, ST2408).

Each node which received the monitoring command to generate the monitoring network graph matrix generates a monitoring network graph matrix and compares it with the initial network graph matrix in order to detect any deviation (ST2303, ST2309). If the detected deviation is the first one, or a different deviation, then the deviation will be recorded in the time array by each communications node (ST2309). As an alternative, the deviation can be sent to the surveillance center 230. As an example, the network graph matrixes shown in FIG. 6(A) and FIG. 6(B) are compared which is the first preferred embodiment, and the network graph matrixes shown in FIG. 16(A) and FIG. 16(B) are compared which is the second preferred embodiment.

Each communication node collects the deviation data detected by other communication nodes, and if the deviation is judged to be an error in terms of its own majority logic, an error message is generated with its own node ID attached, which is sent to the other communication nodes and the recorded deviation data is corrected to the correct deviation data (ST2314). The monitoring network graph matrix is generated periodically after the container departs to the loading yard and until it arrives at the final destination, and the deviation data mentioned above is recorded each time the node detects a deviation (ST2402, ST2408, ST2303, ST2309).

If there is a deviation between the initial and monitoring network graph matrixes, that is greater than a predetermined amount, then the node will judge there was an attack to the network (ST2311). "A large enough deviation" includes the cases in which, firstly, more than a predetermined percentage of the communication nodes cannot establish a direct or indirect communication and, secondly, the communication node has more than a predetermined number of nodal factors which are deviated (to wit, the nodal factor is 1 or 0 in the first preferred embodiment, and distance data between nodes in the second preferred embodiment).

In ST2310, if an illegal invasion or attack to the network is detected resulting from the comparison between the initial and monitoring network graph matrixes, the following countermeasures will be taken.

1) The node that detected the illegal invasion or attack, will delete its own network graph matrix data, including the initial and monitoring network graph matrixes (ST2311).

2) The node will send a command to other nodes to delete their recorded network graph matrix (ST2312). If the node receives such a command, the node will delete its own network graph matrix (ST2304, ST2314).

The following description shows how the object to be monitored, for example, a container, will be treated when the container arrives at the final destination. As shown in FIG. 3, the container arrives at the destination harbor, and is ready to be lifted by the crane 270 at the container yard. Before or during the time that the container is moved, the crane requests control device 220 of the container to read out the initial network graph matrix, and the reporting time of the initial network graph matrix to surveillance center 230, and ID number of the container (ST2205). As an alternative way, the history data of the monitoring network graph matrixes can be read out. After the data is read out, then the date should be encrypted and sent to the crane.

If the crane which reads out the data from control device 220 cannot read out the data (for example, when the data was already deleted) (ST2206), then the crane judges that it is a dangerous container (ST2208). If the crane can read out the data, then the read data is forwarded to surveillance center 230. Surveillance center 230 will compare the forwarded data with the recorded data of the container (ST2207). In the comparison, if there is a deviation between the initial graph matrix sent from the crane and the recorded matrix, then surveillance center 230 will judge that it is a dangerous container, and the center will send a warning to the crane. If the comparison between the initial network matrix and the history data of the network graph matrix shows, for example, the node position on a container door has moved more than a predetermined distance, then the center will judge that the door was illegally opened and it is a dangerous container. Upon receiving notification of the dangerous container from the surveillance center, the crane operator will take a predetermined action, such as moving the container to a safe place (ST2208).

Furthermore, after the security of a container is confirmed, a password must be input to the electronic lock unit 250 which is installed at the container door in order to open the door after the crane unloaded the container from a ship. The password is automatically generated at the surveillance center 230 based on the initial graph matrix and the notification time data to the center. Surveillance center 230 downloads software or data, corresponding to the password, to the electronic lock unit via the control device for opening the container door (ST2209). This download process is performed after the security of a container is confirmed at the final destination. After the software, or the data, is downloaded to the electronic lock unit, surveillance center 230 will send the password for the software or the data for releasing the container door to a person with the authority to open the door, such as a consignee or custom staff, via their cellular phone (ST2210).

Through the steps mentioned above, the container is now ready to be opened by the person who receives the password legally (ST2211). With this arrangement, the surveillance center 230 is able to limit the number of people who can open the container door legally.

First Preferred Embodiment

According to the first preferred embodiment, a plurality of nodes (communication nodes) are configured so that they can communicate with each other by low-power electric waves in the self-organizing communication network. With this configuration, it is possible not only to save battery power, but also to express the spatial status of the communication nodes in a container by the communication links between the nodes. In the system configured above, each node is able to communicate directly only with their neighboring nodes. The self-organizing communication network is disclosed in U.S. Pat. No. 6,028,857.

The following is a description of the communication nodes that are installed in a container to be monitored. A plurality of nodes are randomly installed on the inner walls or door of a container to be monitored. If a consigner can install the node, the consigner can install the node in the cargo loaded within the container. If the container is empty, or a consigner cannot install the node, but the forwarder of the container installs the nodes, then the nodes will not be installed in the cargo.

These nodes will generate the node distribution information by communicating with all of the other nodes and, further, each node collects the node distribution data of the other nodes, then each node will generate the network structure information (to wit, network graph matrix). Using the node distribution information, the communication network is formed which defines the communication route between the nodes. According to this invention, each communication node has at least the capabilities as set forth in 1 through 4 below.

1. ID memory capability (this is a function to record the node number of the node)
2. Wireless communication capability to communicate with its neighboring communication nodes
3. Self-contained battery power supply
4. The capability of memorizing the HOP number table, which relates to all of the communication nodes in the container and the number of communication HOPs which are the relaying counts to communicate with each node via the neighboring communication nodes.

As an option, if the communication nodes have the below-listed capability 5, the communications network also becomes a sensor network.

5. A sensing capability for the local status around the communication nodes (e.g. acceleration, vibration, temperature, the concentration of a specific gas, etc.). For sensing the local status, conventional sensors can be attached to the communication nodes.

Communication with distant nodes takes place only by relaying through the intermediate nodes. To wit, each communication node performs a communication function only if the electric field strength of the message from the other communication node is above a certain level. When the electric field strength of a message from another communication node is above a predetermined level, a link is established between the communicating node and the receiving node. This establishment of links between communication nodes is shown in form in FIG. 5(A). This is called a network graph 500. If there is a direct link between node p and node s in the communication network, the value of 1 is set, and if there is no direct link, and there is an indirect link between node p and node s by relaying other nodes, then the value of 0 is set. When such value setting is done between all of the nodes shown in the network graph, a network graph matrix M (p, s) 600 is formed as shown in FIG. 6(A).

For example, in the case of an out-swinging door with its supporting hinge located in the area of the communication nodes 88 and 360, communications will cease over the following link groups, because the door is opened and the distance increases between communication nodes and the electric field strength of a message from another communication node will be below a predetermined level.

Link (132,10)
Link (449,10)
Link (449,91)

If the door is a sliding door, it can cause the nodes previously located a certain distance from each other to change to a closer position in which a linkage can be established between the nodes. The detecting portion is not limited to a door. An illegal intruder could go into the container through the ventilator or side plate to insert dangerous materials. In such a case, there will be a deviation in link status between the nodes. This link status will result in the deviation in the network graph matrix.

Figure 5:
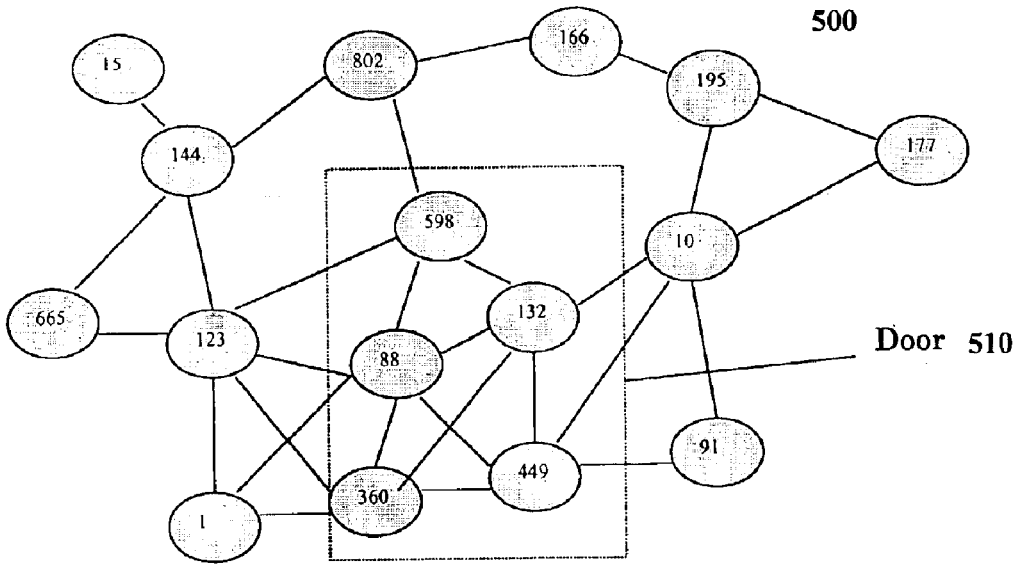
FIG. 5(A) shows a network graph showing a link established between the communicating nodes immediately after the door is closed.
FIG. 5(B) shows a network graph showing a link established between the communicating nodes when the door is opened.
Figure 5:
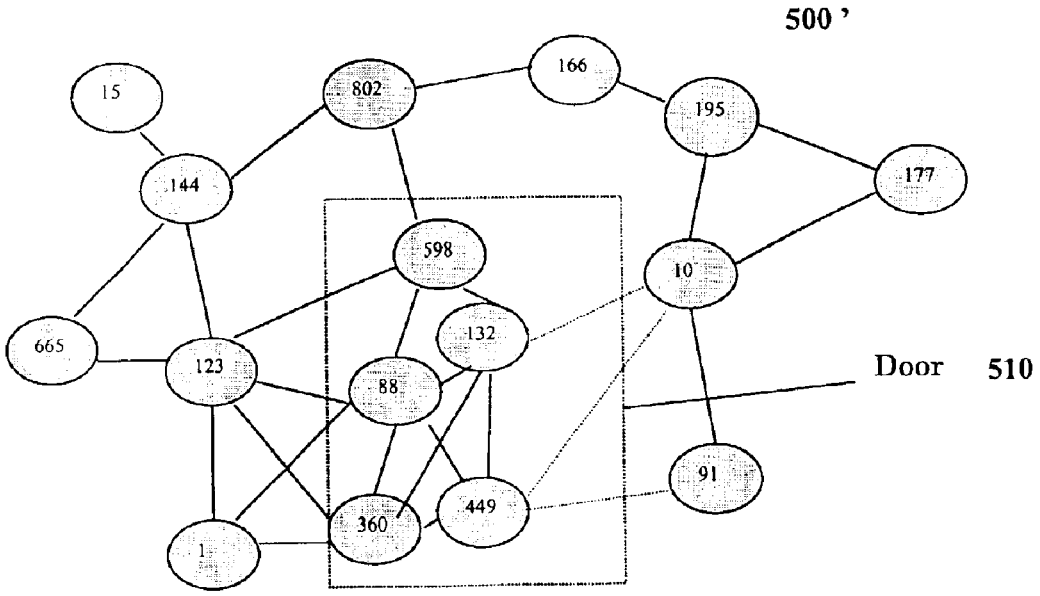

As a result, network graph matrix 600 shown in FIG. 6(A), which was generated by network graph 500 shown in FIG. 5(A), will be changed to network graph matrix 600' shown in FIG. 6(B), which was generated by network graph 500' shown in FIG. 5(B). Accordingly, if an initial network graph matrix at the time when the cargoes are loaded and the door was closed, is different from a monitoring network graph matrix at the monitoring time, it means that there is a possibility of an abnormality in the container. For example, as shown in FIG. 6(B), the value changed from 1 to 0, between nodes 132 and 10, 449 and 10, 449 and 91.

As shown in the above, according to the self-organizing network disclosed in U.S. Pat. No. 6,028,857, the nodal communication between the nodes is controlled by the so-called HOP count, which is a relaying count. In the first preferred embodiment of this invention, the HOP count is set as "0" because the node installed on a container door and the node installed on the neighboring container wall can directly communicate with each other. When the door is opened, the distance between the two nodes will be longer, and direct communication is no longer possible. To wit, the two nodes can communicate only via other nodes, and this makes a change in the HOP count between the two nodes. If the HOP count is changed, then network graph matrix 600, shown in FIG. 6(A), will be changed to network graph matrix 600', shown in FIG. 6(B). By comparing the monitoring network graph matrix generated at the final destination of the container with the initial network graph matrix, an abnormality can be detected if there is a change or deviation between the two matrixes. To wit, the network structure information is obtained from a network graph matrix generated based on the HOP count.

The detecting portion is not limited to a door as explained above, but it is possible that a terrorist could insert dangerous materials in the container. In such cases, if the illegal material was taken out or was located near the nodes or has a size so that it gives any influence to the communication between the nodes, then the influence to the communication will be shown as a deviation or change in the nodal communication and the HOP count between the nodes. If this occurs, such a deviation in the network structure information will be detected as network graph matrix 600', shown in FIG. 6(B), which indicates the possibility of a container abnormality. If a plurality of communication nodes are installed in the container, so that various communication links are formed between the nodes, then the loading in and out of the cargo can be indicated by the changed values in the network graph matrix.

Any deviation in the current network graph matrix from the previous network graph matrix that was generated at the time when the door of the container was closed following the loading of the cargo indicates the possibility of a container abnormality.

Second Preferred Embodiment

Figure 13:
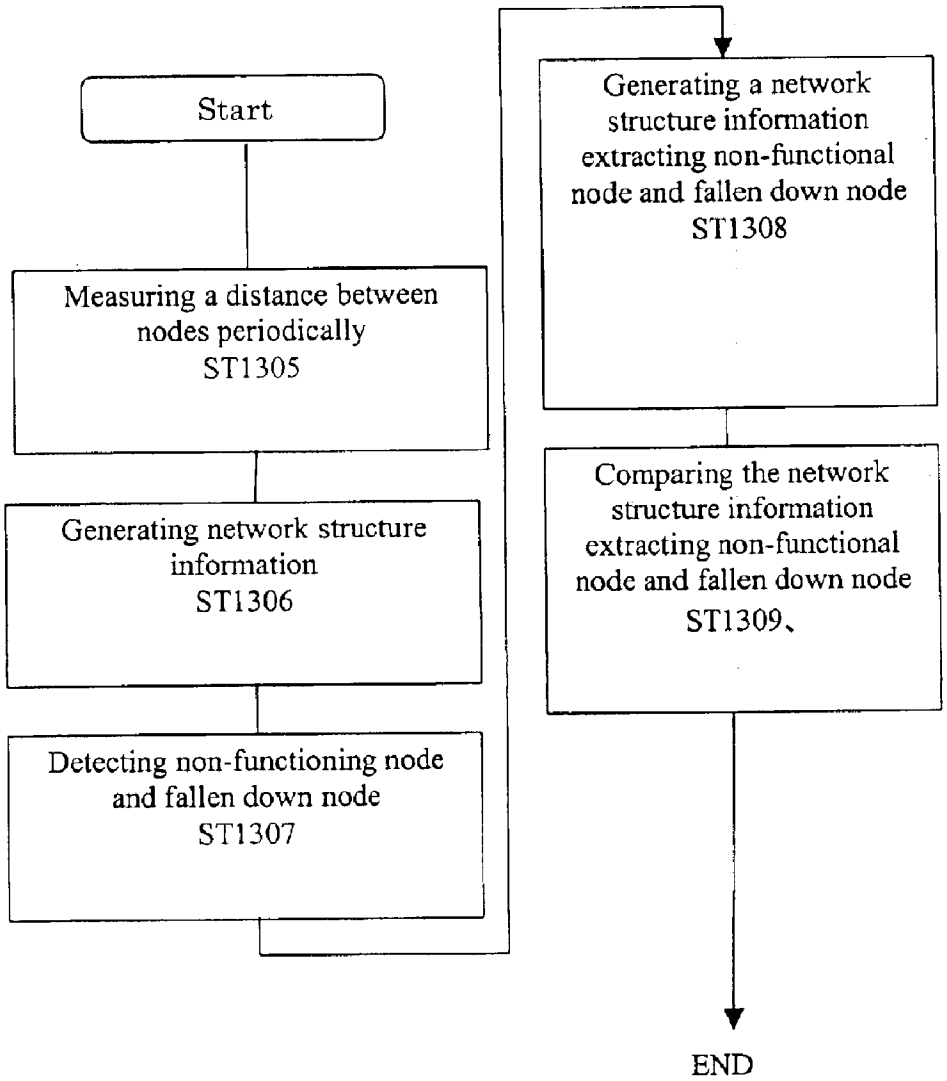
FIG. 13 shows a flowchart in which an initial value of a network structure information is registered as a fingerprint, the changes in the network structure information are monitored, and when the system detects an attack to the seal or an illegal invasion into a container, it deletes the registered fingerprint.

The process flowchart of the second preferred embodiment of this invention is shown in the flowchart of FIG. 13. The flowchart of FIG. 13 is related to the step of ST2309 shown in FIG. 23. FIGS. 22, 23, and 24 are flowcharts showing the processes performed in the surveillance system 200 according to this invention. This second preferred embodiment is characterized by the configuration which is robust to the various communicational situation, such as when a communication is disturbed due to an interruption by an article, a nodal function is stopped, a node has fallen down, or a direct wave is interrupted and indirect wave is transmitted. This characteristic feature is realized by the configuration, which makes it possible to measure the distance between the nodes in the communication network.

Figure 7:
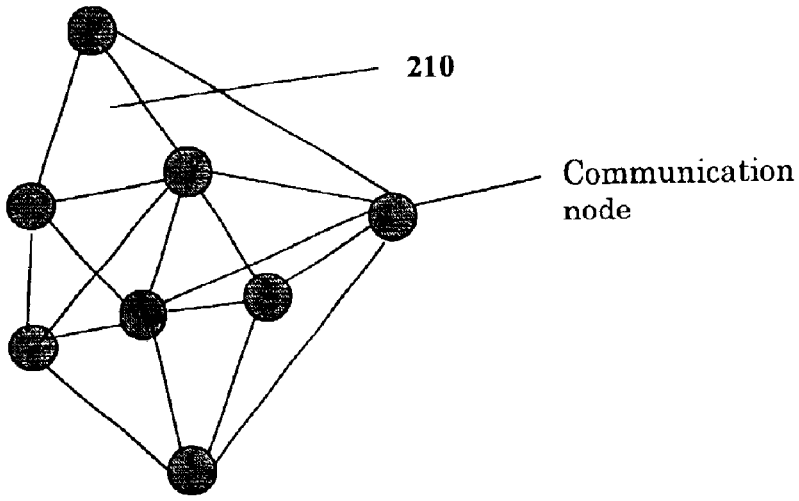
FIG. 7 shows a rough sketch of another network structure for explaining the second preferred embodiment of this invention.

According to the second preferred embodiment, the network structure information of communication network 210 shown in FIG. 7 can be obtained by the direct communication between the nodes by UWB electric waves. To wit, a node A transmits predetermined data to all of the other nodes, then B1, B2, . . . Bn. Nodes B1, B2, . . . Bn which have received the predetermined data, send back the same data to node A by return. The distance between node A and nodes B1, B2, . . . Bn is calculated by the time lag between the transmitted time and each received time. The calculation method will be explained later. The network graph matrix is defined by the distance data between these nodes. Like in the first preferred embodiment, the abnormality in the container is detected by a change or deviation between the initial network graph matrix and the periodically obtained monitoring network graph matrixes. The distance data is not always calculated by the direct UWB waves but is also calculated by the reflected UWB waves of indirect communication which reflect on the container walls. However, once the cargo is loaded into the container, the communication condition should never change in the container, so if the distance between the nodes has changed, then it indicates the possibility of a change or an abnormality in the container.

In the second preferred embodiment, each node communicates with all of the other nodes by UWB waves and the distances between the nodes are measured by such a communication. Based on a change or deviation in a network structure information, the system will detect a deformation of a container, which occurs by an opening or closing of a container door, removing a side plate, or opening or closing a window, etc. Besides the deformation of an object to be monitored, the following: (1), (2), (3), and (4) are the cases which make the change or deviation in the network structure information. In these cases as well, the surveillance system must detect a deformation of an object to be monitored from the change or deviation in the network structure information.

Figure 8:
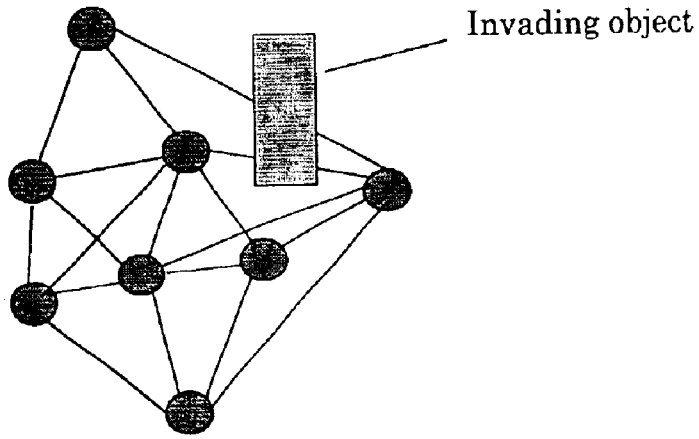
FIG. 8 shows a rough sketch of the network structure when an invading object is located between the communication nodes, for explanation of the second preferred embodiment of this invention.

(1) When a foreign article interrupts the space between some of the nodes, and the interruption makes the communication between some nodes impossible, then there will be some missing portion in the network structure information (FIG. 8).

Figure 9:
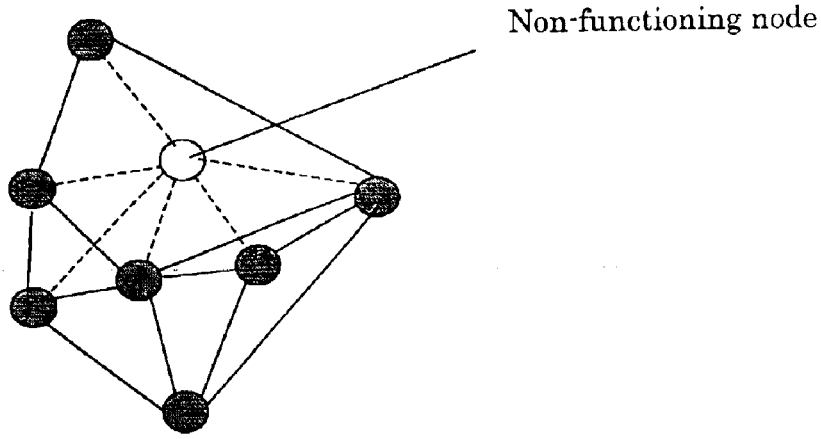
FIG. 9 shows a rough sketch of a network structure when one communication node is not functioning or is missing, for explanation of the second preferred embodiment of this invention.

(2) When some nodes in the network do not function because the battery dies or the battery is shocked, then there will be some missing portion in the network structure information (FIG. 9).

Figure 10:
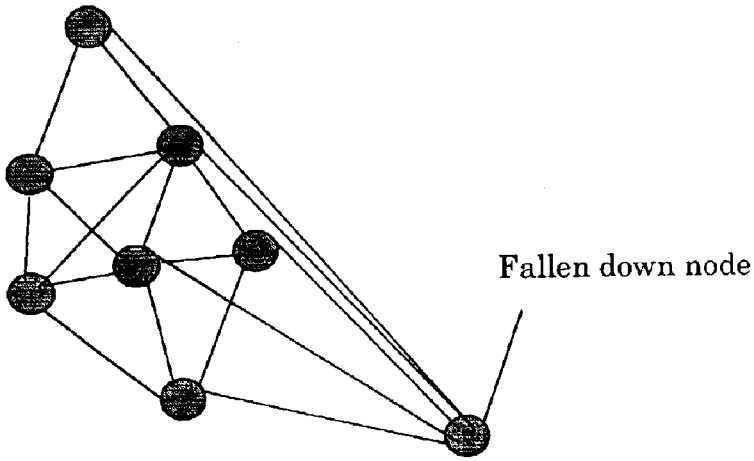
FIG. 10 shows a rough sketch of a network structure when one communication node has fallen down, for explanation of the second preferred embodiment of this invention.

(3) When some nodes fall down from their predetermined positions, then there will be a change in the network structure information (FIG. 10).

Figure 11:
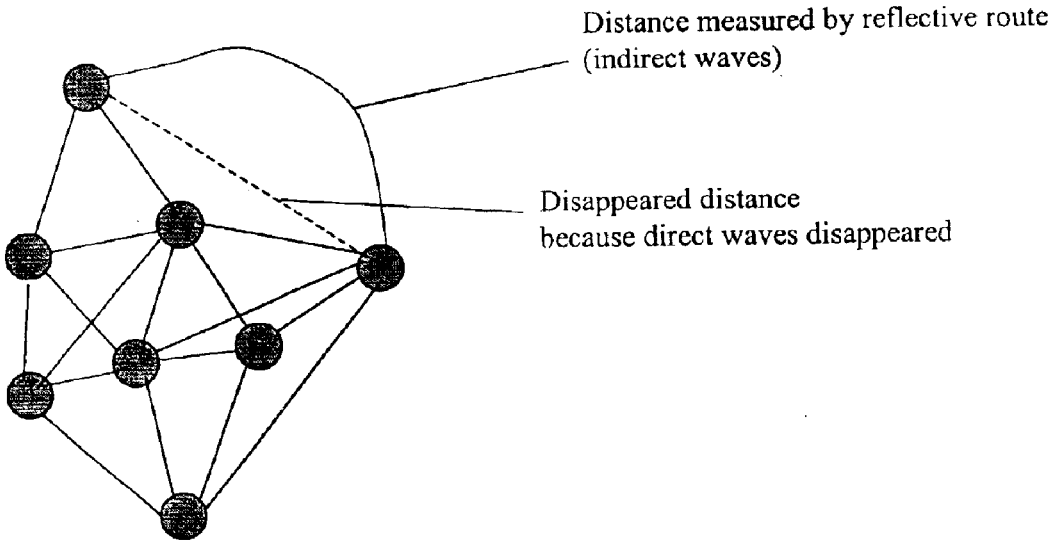
FIG. 11 shows a rough sketch of a network structure when the distance between two nodes, by the in-directional electric waves, but not directional electric waves, according to the second preferred embodiment.

(4) When the direct transmission of waves between the nodes are interrupted, but the reflecting waves are transmitted between the nodes (FIG. 11).

In the network graph matrix, the matrix factor $\alpha$ (s, t) of the spatial relationship between node Ns and node Nt is defined as follows.

$\alpha(s, t)=d(s, t)$: The distance data between node Ns and node Nt $\alpha(s, t)=-1$: No communication In an actual system, all of the nodes do not always function completely at their predetermined positions because some of the nodes may fall down if the container is subjected to heavy vibration or the inner temperature of a container is too hot. When the surveillance system, according to this invention, detects an abnormality of the container through a deformation in the network graph matrix in the examples shown in FIG. 8, FIG. 9, FIG. 10, and FIG. 11, the following assumptions are given for the detection of the abnormality.

Assumption 1: If there is an interruption between the specific nodes, the distance between the other nodes do not change unless the object to be monitored is deformed.

Assumption 2: A node which does not function due to the malfunctions or low battery power cannot communicate with all of the other nodes, and the distance cannot be measured.

Assumption 3: If a node falls down, then the distance to all of the other nodes will be changed.

Assumption 4: If an object to be monitored is deformed, there will be a plurality of nodal groups in which the spatial relationship is not affected by the deformation.

Assumption 5: If the distance between a node and a plurality of other nodes, except a specific node, stays the same, but the distance between the node and the specific node becomes greater, then the communication between the node and the other specific node changes from a direct wave communication to an indirect wave communication.

If the door provided with node N1 and N2 is opened, in a communication network provided with a network structure information shown in FIG. 12(A), then the distance between N1 and N2 will stay the same, but the distance between N1, N2 and all of the other nodes will be changed according with the opening action of the door. This change can be detected by comparing the monitoring network structure information (for example, the information shown in FIG. 12(B)) with the initial network structure information (for example, the information shown in FIG. 12(A)). For the comparison of the information, the nodes which are not functioning and those which fall down, as shown in FIG. 9 and FIG. 10, are omitted, and only other available nodes are used for generating the initial and monitoring network structure information. The process flowchart is shown in FIG. 13.

In order to make the step ST2309 in FIG. 23 robust, the process shown in FIG. 13 is performed. As a first step, each node measures the distance to all of the other nodes (ST1305). The distance measurement is performed at all of the nodes, and the detected distance data of each node to all of the other nodes are collected together to obtain the monitoring network graph matrix shown in FIG. 15(B) (ST1306). As mentioned above, not all of the nodes are always functioning at their predetermined positions. The non-functional nodes and the fallen down nodes are detected (ST1307) by comparing the initial network graph matrix with the monitoring network graph matrix and analyzing the comparison result. In this example, as shown in FIG. 15(B), it is judged that a node, where the distance data to all of the other nodes is indicated by a "1", is a non-functional node. Furthermore, comparing with the initial graph matrix indicated by the distance, it is judged that a node, where the distance data to all of the other nodes has a deviation that is more than a predetermined value, is a fallen down node (for example, N5).

As a next step, the initial and monitoring network graph matrixes configured by the distance data other than the non-functioning nodes and the fallen down nodes, as shown in FIG. 16(A) and FIG. 16(B), are extracted from the initial and monitoring network graph matrixes shown in FIG. 15(A), and FIG. 15(B) (ST1308).

Furthermore, according to the process flow explained later, the extracted initial and monitoring network graph matrixes shown in FIG. 16(A) and FIG. 16(B) are compared with each other, and the deformation of an object to be monitored, the illegal invasion between the nodes, and the distance measurement by indirect waves, are detected (ST1309).

Figure 14:
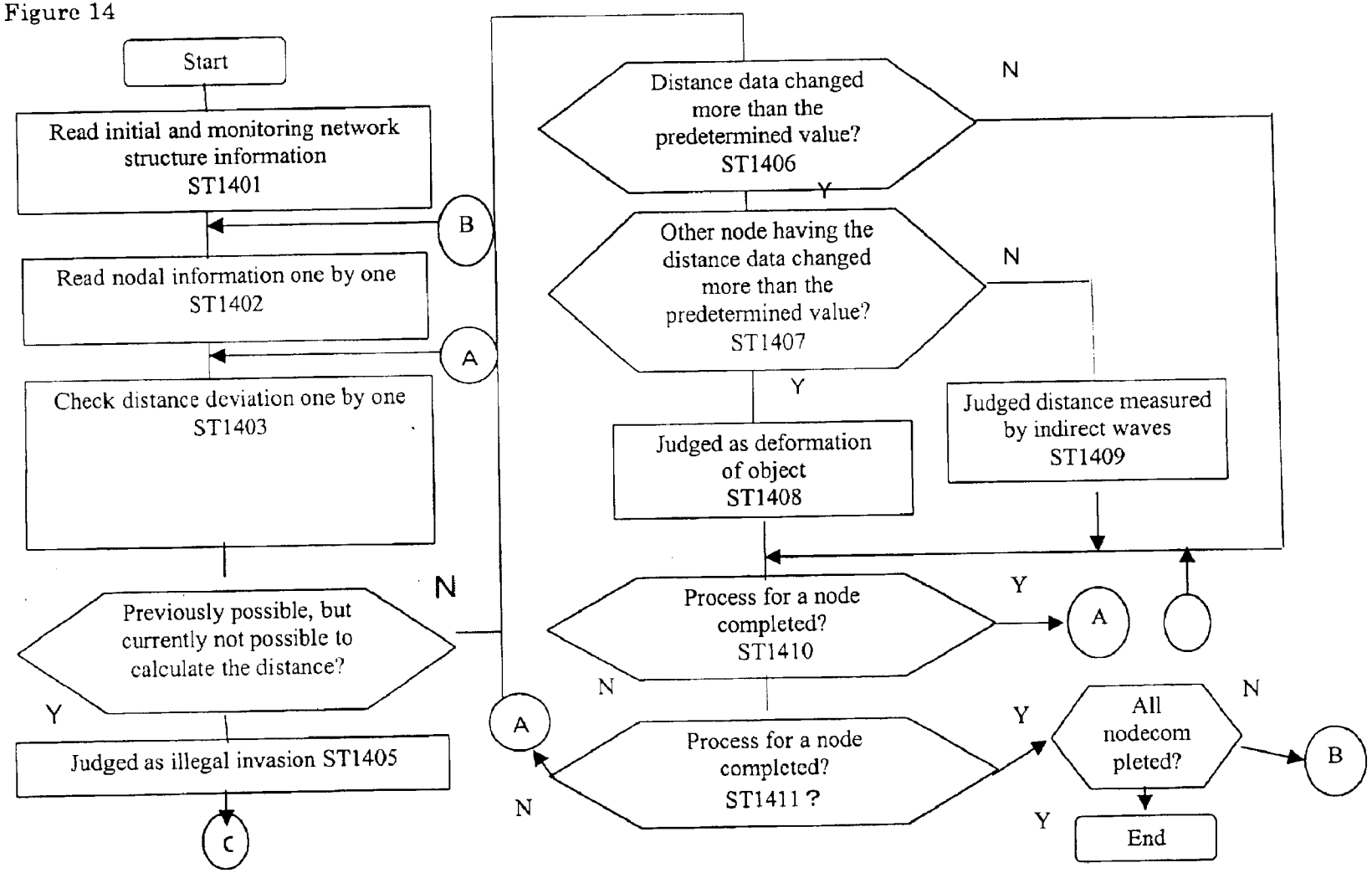
FIG. 14 is a detailed flowchart in step 1309 shown in FIG. 13.

By comparing the extracted network structure information shown in FIG. 16(A), FIG. 16(B), which is mentioned at ST1308, the detailed process for detecting the deformation of an object to be monitored, the illegal invasion between the nodes, and the distance measurement by indirect waves, will be explained referring to the flowchart shown in FIG. 14 as follows.

Firstly, the initial graph matrix shown in FIG. 16(A) and the monitoring graph matrix shown in FIG. 16(B) are read in (ST1401). A set of distance data of a node are read one by one (ST1402), and the distance data as link information in the read matrixes is checked one by one, and it is detected if there is any change or deviation between the distance data of the two matrixes (ST1403). For example, distance data of node 1 to other nodes, N2, N4, and N6 are checked one by one. If there is a node which was previously possible to calculate the distance, but currently not possible to calculate the distance, then it is judged that there was an illegal invasion between the nodes (ST1404, ST1405).

If the calculation is possible, and the distance data changed more than a predetermined value, and furthermore, there are more nodes in which the distance data changed more than the predetermined value (ST1406, ST1407), then it is judged that there was a deformation of the object to be-monitored (for example, the door was opened illegally). If the distance data did not change more than the predetermined value, then the next node will be checked (ST1410, ST1411, ST1403). If the distance data did not change more than a predetermined value, then it is judged that the distance data was calculated based on the indirect waves (ST1409). To wit, the communication route changed from a direct wave route to an indirect wave route. The process mentioned above is performed for each node to all of the other nodes.

FIG. 16(A) and FIG. 16(B) show the actual example of the matrix for the process mentioned above. To wit, a fingerprint extracted from the initial network graph matrix shown in FIG. 16(A) is compared with the monitoring network graph matrix shown in FIG. 16(B). In these Figures, α (N2, N4) is different between the fingerprint and the monitoring graph matrix, and the plus value changed to "−1". It is, therefore, judged that there was an illegal invasion between node N2 and node N4. Furthermore, the distance data between N1 and N6 changed from 80 to 93. The deviation value is 13. If the deviation value of 13 is judged to be within the predetermined value, then it is judged that it is a measuring error. But if the deviation value of 13 is judged to be more than the predetermined value, and if there are other nodes which have distance deviations to N1, it is judged that there was a deformation of the object to be monitored. In this case, the distance between N1 and N4 changed from 25 to 35. It is, therefore, judged that the vicinity area of N1 (for example, a door) was deformed against the vicinity area of N4 and N6 (for example, a door frame). In this case, if the nodes of invasion exceeds more than a predetermined value, or the total deviation value of the nodes of deformation exceeds more than a predetermined value, then it can be judged that there was an attack to the object to be monitored.

Hardware Configuration of Each Node

Figure 17:
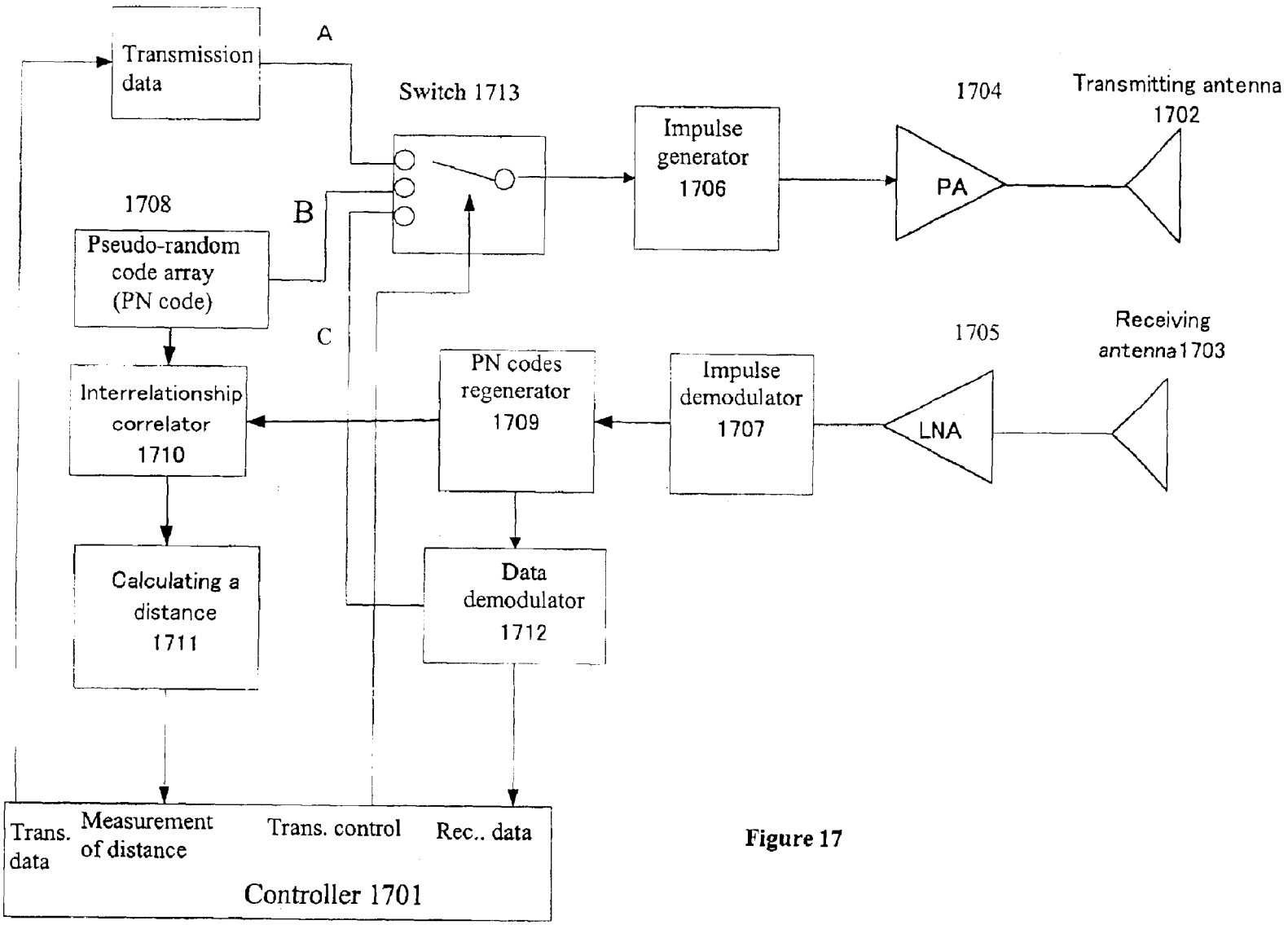
FIG. 17 shows a partial block diagram for measuring the distance by UWB and data transmission according to the second preferred embodiment.

FIG. 17 shows a functional block diagram of a communication node which measures the distance between the node and the other nodes using UWB waves according to the second preferred embodiment of this invention. Communication node 1700 comprises controller 1701 which controls the function of the node, transmitting antenna 1702, receiving antenna 1703, pulse amplifier (PA) 1704, low noise amplifier (LNA) 1705, impulse generator 1706, impulse demodulator 1707, pseudo-random code array (PN codes) generator 1708, PN codes regenerator 1709, interrelationship correlator 1710, distance calculator 1711, data demodulator 1712, and switch 1713. Controller 1701 performs the above mentioned process as well. Controller 1701 has a memory means which records the ID number of the node, an initial network graph matrix and a monitoring network graph matrix (not shown).

Each node has a function for measuring a distance as shown in FIG. 18, and a function for data communication as shown in FIG. 20. Each node needs to know the ID number of a corresponding node to communicate in order to perform a data communication to the corresponding node and to measure the distance to the corresponding node. To wit, before measuring the distance or performing the data communication, each node obtains and records the ID number of all of the other nodes in the network to which the node communicates directly or indirectly (by relaying a message to the other nodes) by using a prior technology (for example, a technology disclosed in Japanese Patent Publication Hei5-75612).

Pre-Process for Measuring a Distance by UWB Waves

As an example, the following description is for measuring the distance between node A and node B by UWB waves. In each communication node, switch 1713 is turned to A terminal. In this mode, the node transmits data from a transmitting antenna, and data received by the receiving antenna is sent to controller 1701 via data demodulator 1712. In this mode, each node monitors incoming data from the receiving antenna. Before measuring the distance to node B, communication node A sends a request command, ReqDist (B) to all of the other nodes, which commands "all of the other nodes, except node B, should ignore the received PN code sent from node A, and should not sent it back to node A. Only node B should send the received PN code to node A as it is". After the request is received at node B, node B turns the switch to C terminal so that the output of data demodulator 1712 can be sent to impulse generator 1706. After node B receives the ReqDist (B) and a predetermined time has passed, or data demodulator 1712 proceeds to output the received PN code to switch 1713, then switch 1713 of node B is turned back to terminal A, and goes back to the node to monitor the output form data demodulator 1712 by controller 1701.

Performing a Distance Measurement by UWB Waves

After node A sends the command of ReqDist (B), switch 1713, shown in FIG. 17, is turned to B terminal, and a code array for measuring a distance (PN codes) 1708 is transmitted from transmitting antenna 1702 via impulse generator 1706 and PA 1704. By this transmission, node A receives the identical PN codes from node B, which is identical to the transmitted PN codes from node A. The received identical PN codes at node A by receiving antenna 1703 are amplified by LNA 1705, and impulse demodulated by impulse demodulator 1707. Then, PN codes are regenerated from the impulse demodulated output by PN codes regenerator 1709. The chip count is obtained from the regenerated PN codes and the original PN codes sent from code A, which can indicate the time lag. The maximum chip count to be obtained at each node is within the chip count of one transmitted PN codes cycle.

Figures 19A, 19B:
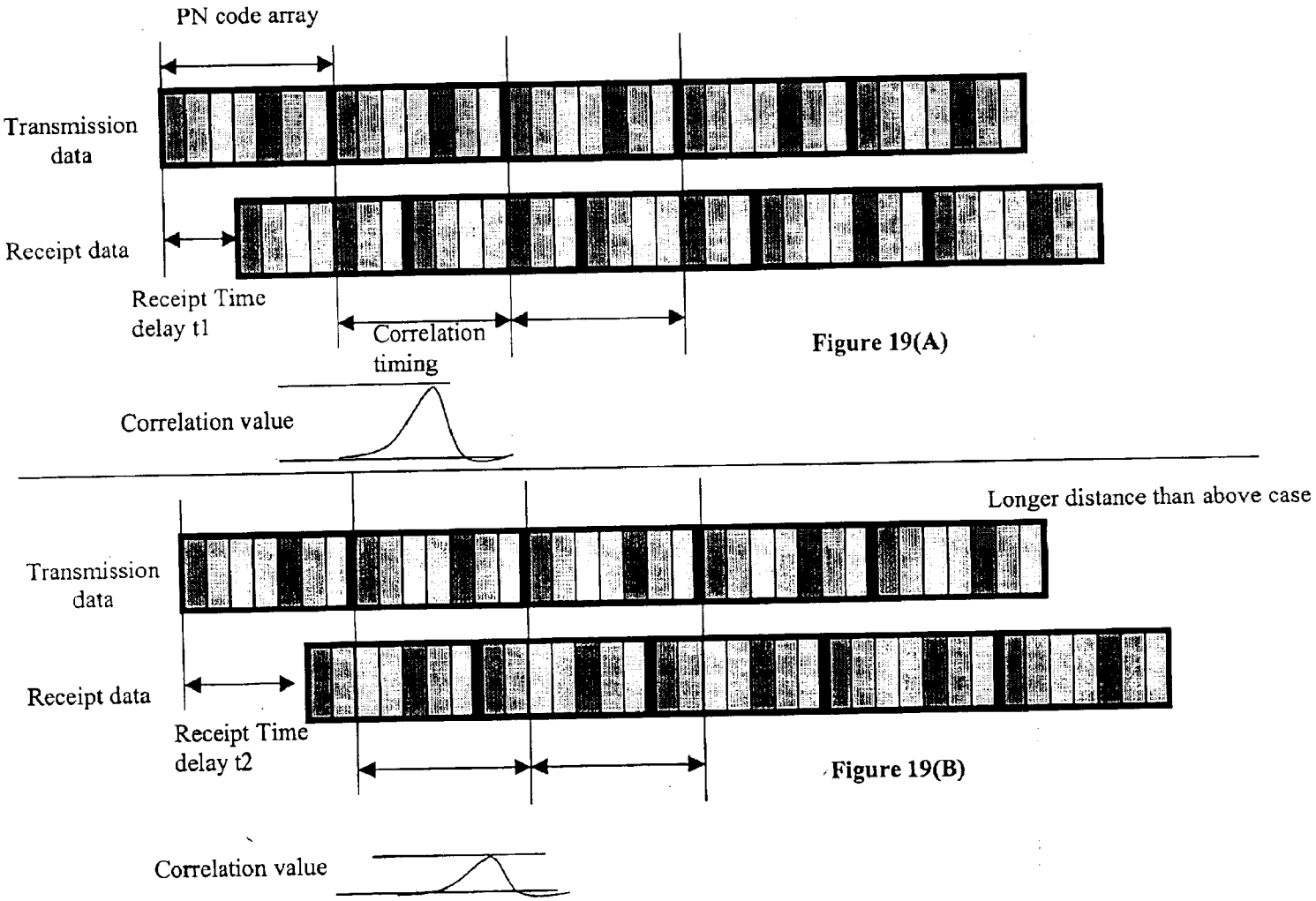
FIG. 19 shows a rough sketch of a correlation calculation to explain the correlation between the transmitting data and receiving data, which is used for calculating the distance according to the second preferred embodiment.

The obtained chip count indicating the time lag is subtracted by the predetermined delay time in the node, and then divided by 2 so that the distance between node A and node B can be shown by the calculated chip count. The actual distance between node A and Node B is calculated by multiplying the known distance corresponding to one chip to the calculated chip count. To wit, as shown in the overall process in FIG. 20, the measuring codes are sent from node A to node B, node B receives the measuring codes and sends them back to node A as they are. Then, node A checks the correlation between the received PN codes in the received measuring code and the original PN codes in the original measuring code. The chip count corresponding to the maximum nodal delay between the received and original measuring codes, and the net time length to travel from node A to node B is obtained, and then, the distance between node A and node B is calculated based on the net time length. The amount of nodal delay between the transmitted data and the received data is measured as shown in FIG. 19(A) and FIG. 19(B), and the data transmission and receipt between node A and node B is performed as shown in FIG. 20.

After the distance measurement between node A and node B is completed, node A continues the same process to the other nodes to which node A can communicate directly, one by one indicating the ID number of the ID numbers. Then, node A records a set of distance data to the other nodes (node distribution information) in a memory means in the controller. Once other nodes request node A to send the set of distances to the nodes, node A will send the set of distances to the nodes. After the distance measuring process mentioned above is completed at node A and all of the other nodes, the switch is turned to A terminal and the controller will go into the monitoring mode to monitor the output from the data demodulator. To wit, node A will be shifted to the waiting mode in which data communication is available, as shown in FIG. 20. The process mentioned above is performed in all of the nodes for measuring the distances to the other nodes.

Measuring the Distances to the Neighboring Nodes

In the second preferred embodiment of this invention, by adding the following process, it becomes possible to measure the distance to the neighboring article. According to this process, more detailed monitoring is possible than the above mentioned process to simply measure the distances between the nodes.

Figure 21:
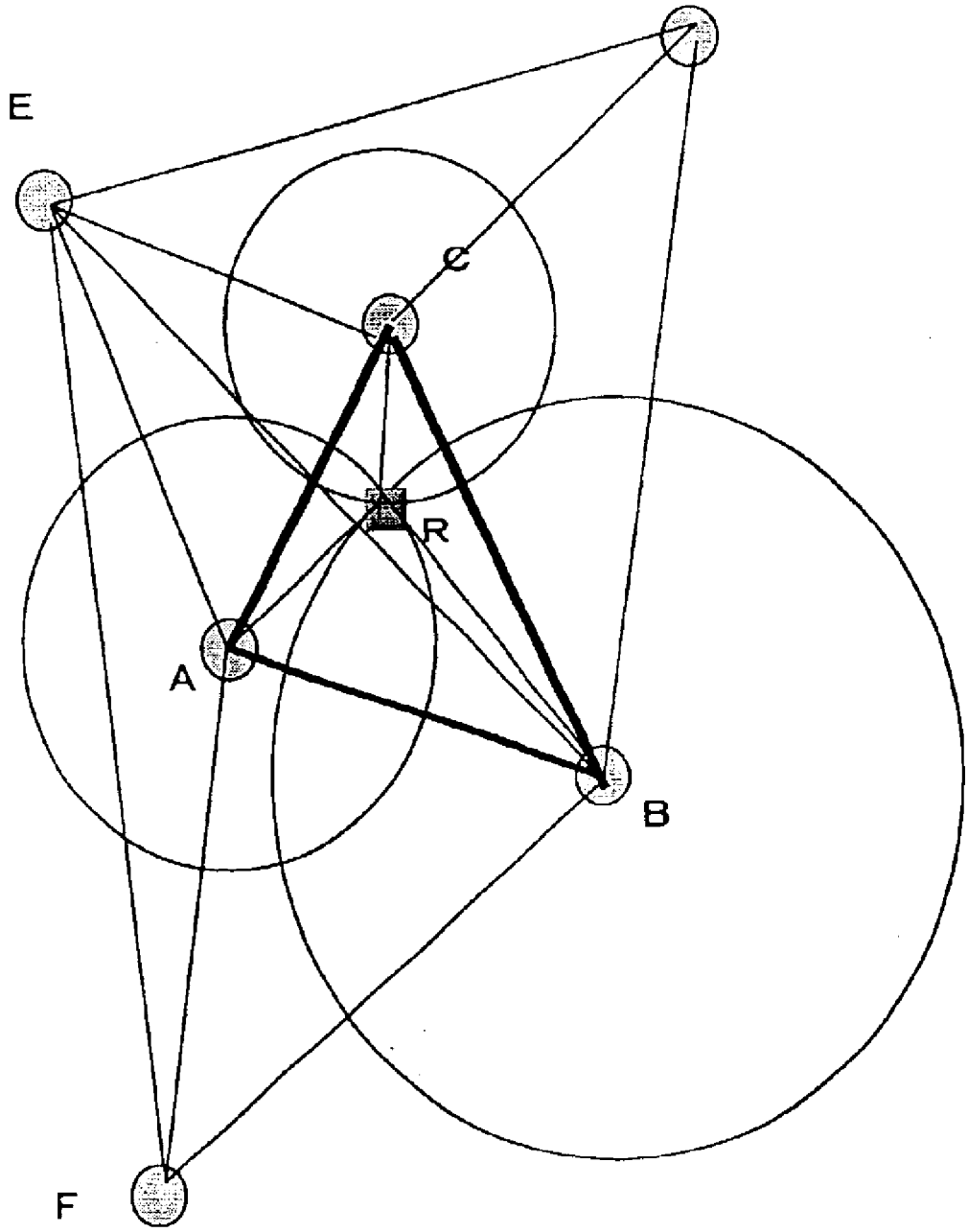
FIG. 21 shows a rough sketch to explain the mesh cell according to the second preferred embodiment.

To wit, after measuring the distance between the nodes mentioned above, each node successively measures the distance to a neighboring article as shown FIG. 21. In this example, each node measures a slightly shorter distance than the distance to the closest node (for example, 90% of the distance to the closest node). This can be achieved by setting the maximum PN code shifting value to the proper value corresponding to a slightly shorter distance to the closest node. The PN code shifting is performed for correlating between the transmitting PN codes and the receiving PN codes when the distance measurement is performed.

As shown in FIG. 21, a triangle mesh is formed by three communication nodes which are not located on a straight line in a graph configured by a plurality of nodes. In this example, there is no communication node within the triangle mesh formed by communication node A, node B, and node C, but there is node A within the triangle mesh formed by communication node E, node F, and node B. The mesh having no other node within the mesh is called a mesh-cell. Each mesh-cell can detect and record if there is an article R within the mesh-cell, which can reflect the electric waves from the nodes. Furthermore, it can detect the characteristics of the article R.

A method to distinguish if a mesh is formed by the randomly selected three communication nodes A, B, and C, is as follows. To-wit, the condition of a mesh-cell is to satisfy the following two conditions.

Condition 1; If nodes A, B, and C, satisfy the following conditions, then they can form a mesh of triangle shape.

$$\text{Length}(A, B) < (\text{Length}(B, C) + \text{Length}(C, A))$$

$$\text{Length}(B, C) < (\text{Length}(C, A) + \text{Length}(A, B))$$

$$\text{Length}(C, A) < (\text{Length}(A, B) + \text{Length}(B, C))$$

Condition 2: If the mesh A,B,C satisfies the following conditions, then it is a mesh-cell.

$$(\text{Length}(R, A) + \text{Length}(R, B) + \text{Length}(R, C)) < (\text{Length}(A, B) + \text{Length}(B, C) + \text{Length}(C, A))$$

Firstly, by analyzing the matrix shown in FIG. 16(B) which indicates the distances between the communication nodes, mesh-cells can be extracted. Then, a mesh-cell number is assigned to each extracted mesh-cell, and a proximate status table can be generated which contains the information, such as if there is an article R within the mesh-cell, etc. This information can be accessed by indicating the mesh-cell number.

$$(\text{Length}(R, A) + \text{Length}(R, B) + \text{Length}(R, C)) < (\text{Length}(A, B) + \text{Length}(B, C) + \text{Length}(C, A))$$

For example, a mesh-cell formed by nodes A, B, C is supposed to be assigned mesh-cell number 5. Then in the fifth line of the proximate status table, the information is recorded, such as if the mesh-cell includes an article R or not, the power levels of received waves which are reflective waves from the nodes, and the distances between the nodes and the article R. Since the proximate status table can include the initial status information, such as, if there was an article within the mesh-cell or not, and the property of the article, if the above process is performed in each mesh-cell it is possible to detect a status deviation by comparing the initial proximate status table and the proximate status table at the time of monitoring. If any deviation is detected between the proximate status tables, it means that there is a possibility that an article was carried into, or out from, the mesh-cell. If an article is carried out, one example of such a status is that something was stolen from a freight container. If an article is carried in, one example of such a status is that somebody drilled a container wall and made a hole in order to load some illegal articles, or some foreign article was illegally loaded in the container after the legal loading was completed and the door was closed. The foreign article, could be a dangerous article.

Illegal Access on a Container Ship

The illegal access to a container is not limited during the time of transportation on the ground. To wit, it is not always possible to prevent illegal persons from gaining access to containers stacked one on top of another on board of a container ship. If the containers to be monitored are stacked in this manner, the containers can communicate with a master antenna provided on the ship (not shown in the attached drawings) via long distance antenna 413. Long distance antenna 413 located on a container door is, however, usually not installed in a position from which the master antenna, provided on the ship, can be seen without being interrupted by an obstacle. In this case, a plurality of relay antennas can be installed on the dry fence, at a predetermined interval length. This dry fence is installed around the dry deck in order to prevent crew members from falling into the sea. If there is a relay antenna on the dry fence in a position which long distance antenna 413 provided on a container door can observe, then all the containers on the ship can wirelessly communicate with a main computer provided on the ship. It is because the container can communicate with the neighboring containers located at the upper, lower, right, and left positions of the container, that they can form a self-organizing communication network. This arrangement can be provided for each row of the stacked containers, and a container stacked at an edge of a container row can communicate with the relay antenna. Furthermore, each relay antenna can be a communication node to form a self-organizing network, and each relay antenna automatically forms a communication link with each other. By configuring the network as mentioned above, each control device (a node) in a container, having long distance antenna 413, a relay antenna on the dry fence installed on a dry deck, and the communication device provided in the communication room of a ship, can form a self-organizing network as a whole. This network can be formed for containers loaded within a ship hold. In a ship hold, the relay antenna can be installed at proper positions to which the long distance antenna 413 of a container can communicate. By arranging in this manner, a self-organizing network can be formed which uses the containers as communication nodes. This arrangement enables the communication between the containers and the communication device installed in the ship hold and, further, enables communication with a communication device provided in the communication room of a ship so that notification of container status information to the outside, and an inquiry from the outside, become possible.

Consequently, all containers loaded on a freight container ship can communicate with a communication device provided in the communication room of the ship. Since each container can periodically transmit status information to the communication room in the ship, it is then possible to monitor whether or not the door-has been opened or closed, and if it has been drilled. As a result, for example, it becomes possible to notify the Cost Guard of any abnormal event in the loaded containers before the container ship arrives into the territorial waters of the United States.

Effects of the Invention

Since the "Hagoromo" method is used as an inside-seal, according to this invention, no one can observe it from the outside, which is different from conventional sealings. This arrangement can prevent terrorists pre-arranging the illegal opening and closing of a door of the container, or freezing the electronic circuit to fool the detection function for detecting opening and closing of the door.

Since a communication status in a space loaded with freight cargo is monitored according to this invention, and a space has no relation to properties of freight cargos, this monitoring method is a universal monitoring method compared to conventional monitoring methods, and it is easily used to monitor a container which loads various natures of cargos.

Since the communication nodes, according to the "Hagoromo" method of this invention, are provided basically at random positions in a container, this makes it more difficult for illegal operators, or terrorists, to fool the surveillance system.

The password for opening and closing a door according to this invention is automatically generated at a surveillance center, which is separate from the container operating companies. This arrangement can prevent the password from being leaked by illegal operators.

Since the electronic fingerprint is randomly generated, it will not be possible to generate an identical one. When terrorists prepare a bogus container to swap with the real container, it is not possible to copy the true password, because the true password has been deleted.

When a predetermined amount of deviation between a recorded network graph matrix and a later network graph matrix is detected, the recorded data will be deleted. This makes it impossible to generate the same data again. This arrangement, therefore, makes it impossible for terrorists to copy the same data and input the copied data into a bogus container.

In addition to detecting the illegal opening or closing of the door, the surveillance system, according to this invention, can detect whether dangerous materials have been inserted through a hole made by a drill or burner by providing sensors on the walls of a container.

Since a self-organizing network communication is employed, according to the first preferred embodiment, each node can communicate with each other node, saving electric power. Further, since the surveillance system according to this invention is configured to express the nodal spatial relationship by communication links between nodes, it is possible to monitor an inner space of a container by a universal method. Since communication links can express the spatial status of nodes by nodal distance measured by UWB communication, it is possible to precisely measure a plurality of distances between nodes.

What is claimed is:

1. A status surveillance system to survey a movement of an object to be surveyed and a spatial status in the proximate space of said object by a network structure information which is generated by assembling a plurality of communication link statuses, said network being configured by a plurality of wireless communication nodes which are attached to said object to be surveyed, wherein said wireless communication node comprises:

1) a data communication means to communicate transmission data to other wireless communication nodes; and 2) a link status detecting means to detect and memorize a link status with other wireless communication nodes, wherein said link status detecting means detects a relay count to relay a message between said wireless communication nodes, or a characteristic value to be generated based on said relay count.

2. The status surveillance system according to claim 1, wherein said network structure information is generated from a totality or a portion of a network graph matrix.

3. The status surveillance system according to claim 1, wherein said network structure information is generated from a totality or a portion of a network graph matrix in which the non-functioning or fallen down nodes were extracted.

4. The status surveillance system according to claim 1, wherein said object to be surveyed is an object having an inner space which is accessible through a door or a window, and said wireless communication nodes are attached inside surface of said inner space for monitoring said object from the inside.

5. The status surveillance system claim 4, wherein a communication between said inner space on which said communication nodes are installed and an outer space is performed via an electro magnetic type communication device which is used during said inner space is closed.

6. The status surveillance system according to claim 1, further comprising a sensor device provided in each communication node to detect the local status of a neighboring space around said communication node, wherein said status surveillance system judges there is an abnormality in said object if said sensor device outputs an abnormal local status signal.

7. The status surveillance system according to claim 6, wherein said sensor device is a vibration sensor to detect a vibration of said object to be surveyed, a temperature sensor to detect the temperature of said object, or an invasion detecting sensor to detect an invasion from outside of said object.

8. A status surveillance system to survey the inside status of a container during a transportation, comprising;

a communication network comprising a plurality of communication nodes which hare installed randomly or regularly in said container;

a network structure information generating means to generate a network structure information from a characteristic distribution information of said plurality of communication nodes;

an initial network structure information recording means to record an initial network structure information of said container to be surveyed, which is generated by said network structure information generating means;

a monitoring network structure information recording means to record a monitoring network structure information of said container to be surveyed, which is generated by said network structure information generating means in a predetermined time interval;

a comparison means to compare said initial network structure information recorded in said initial network structure information recording means and said monitoring network structure information recorded in said monitoring network structure information recording means, and output a comparison result; and a surveillance center to receive said comparison result from said comparison means, wherein, if said comparison result from said comparison means has more than a predetermined deviation, then said surveillance center sends a warning signal to an unloading crane to handle said container with special attention.

9. The status surveillance system according to claim 8, wherein, if said comparison result from said comparison means has more than a predetermined deviation, then said surveillance center sets an automatically generated electronic locking software or data to be an electronic lock system provided on said container, and said surveillance center sends a corresponding password via a separate safe route.

10. A status surveillance method to survey the inside status of a container during a transportation, comprising the steps of:

installing a communication network comprising a plurality of communication nodes which are installed randomly or regularly in said container;

generating an initial network structure information from a characteristic distribution information of said plurality of communication nodes at the time of shipping, and recording said initial network structure information;

recording a monitoring network structure information of an inner space or an object to be monitored installed in said inner space in a predetermined time interval after the container has shipped out;

comparing said initial network structure information and said monitoring network structure information, and outputting a comparison result; and sending a warning signal to an unloading crane to handle said container with special attention if said comparison result has more than a predetermined deviation.

11. A status surveillance system to survey a movement of an object to be surveyed and a spatial status in the proximate space of said object by a network structure information which is generated by assemblina a plurality of communication link statuses, said network being configured by a plurality of wireless communication nodes which are attached to said object to be surveyed, said status surveillance system further comprising a transmitting means to transmit said network structure information generated at a predetermined time to a surveying center located at a remote location from said object, said network structure information being used as an ID information of said object to be surveyed, wherein said wireless communication node comprises:

1) a data communication means to communicate transmission data to other wireless communication nodes; and 2) a link status detecting means to detect and memorize a link status with other wireless communication nodes, wherein said link status detecting means detects the nodal distances between said wireless communication nodes.

12. The status surveillance system according to clam 11, further comprising:

an initial network structure information recording means to record an initial network structure information of said object to be surveyed, said initial network structure information being assembled by a network structure information assembling means;

a monitoring network structure information recording means to record a monitoring network structure information of said object to be surveyed in a predetermined time interval, said monitoring network structure information being assembled by said network structure information assembling means; and a comparing means to compare said initial network structure information with said monitoring network structure information, and output the comparison result.

13. The status surveillance system according to claim 12, wherein, when a deviation resulting from said comparison between said initial network structure information and said monitoring network structure information is more than a predetermined value, or said comparison itself is not possible to execute, or a communication with other communication nodes is not possible, then said status surveillance system judges there is an abnormality in said object to be surveyed, and deletes said network structure information recorded in each communication node.

14. The status surveillance system according to claim 11, further comprising an information transmitting means to transmit an initial network structure information of said object and a monitoring network structure information at a predetermined time interval, which are generated by a network structure information generating means, to a surveillance center which is located at a remote location from said object to be surveyed.

15. The status surveillance system according to claim 14, wherein, when a deviation resulting from said comparison between said initial network structure information and said monitoring network structure information is more than a predetermined value, or said comparison itself is not possible to execute, or a communication with other communication nodes is not possible, then said status surveillance system judges there is an abnormality in said object to be surveyed, and deletes said network structure information recorded in each node if said network structure information is already recorded in said surveillance center.

16. The status surveillance system according to claim 11, wherein said link status detecting means detects a relay count to relay a message between said wireless communication nodes, or a characteristic value to be generated based on said relay count.

17. The status surveillance system according to claim 11, wherein said network structure information is generated from a totality or a portion of a network graph matrix.

18. The status surveillance system according to claim 11, wherein said network structure information is generated from a totality or a portion of a network graph matrix in which the non-functioning or fallen down nodes were extracted.

19. The status surveillance system according to claim 11, further comprising a sensor device provided in each communication node to detect the local status of a neighboring space around said communication node, wherein said status surveillance system judges there is an abnormality in said object if said sensor device outputs an abnormal local status signal.

* * * * *